US009606504B2

(12) United States Patent
Shimizu

(10) Patent No.: US 9,606,504 B2
(45) Date of Patent: Mar. 28, 2017

(54) IMAGE FORMING DEVICE

(71) Applicant: Brother Kogyo Kabushiki Kaisha, Nagoya-shi, Aichi-ken (JP)

(72) Inventor: Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/491,157

(22) Filed: Sep. 19, 2014

(65) Prior Publication Data

US 2015/0086222 A1 Mar. 26, 2015

(30) Foreign Application Priority Data

Sep. 20, 2013 (JP) ..... 2013-195539

(51) Int. Cl.
*G03G 15/00* (2006.01)
*G03G 21/16* (2006.01)
*G03G 21/18* (2006.01)

(52) U.S. Cl.
CPC ..... *G03G 21/1661* (2013.01); *G03G 21/1896* (2013.01); *G03G 2221/1648* (2013.01); *G03G 2221/1892* (2013.01)

(58) Field of Classification Search
USPC ..... 399/13, 12
See application file for complete search history.

(56) References Cited

U.S. PATENT DOCUMENTS 4,974,020 A * 11/1990 Takamatsu et al. ..... 399/12
5,053,816 A 10/1991 Takahashi
5,489,976 A 2/1996 Ichikawa
5,495,323 A 2/1996 Meetze, Jr.
5,495,327 A 2/1996 Inomata
5,640,651 A 6/1997 Katoh et al.
5,649,264 A 7/1997 Domon et al.
5,970,293 A 10/1999 Huang
6,088,561 A 7/2000 Kawamura et al.
(Continued)

FOREIGN PATENT DOCUMENTS

AU 2010281279 B2 2/2014
CN 1445624 A 10/2003
(Continued)

OTHER PUBLICATIONS

Apr. 26, 2011—(WO) International Search Report (JPO)—App PCT/JP2011/057946.
(Continued)

*Primary Examiner* — Clayton E Laballe
*Assistant Examiner* — Warren K Fenwick
(74) *Attorney, Agent, or Firm* — Banner & Witcoff, Ltd.

(57) ABSTRACT

An image forming apparatus includes an apparatus main body and a cartridge configured to be mounted to and detached from the apparatus main body. The cartridge includes a rotating member which is configured to rotate and comprises a detected portion and a first engaging portion. The apparatus main body includes a detecting portion configured to detect the detected portion and a second engaging portion configured to engage with the first engaging portion. At least when the detecting portion detects the detected portion, the first engaging portion and the second engaging portion are engaged with each other by rotation of the rotating member.

17 Claims, 16 Drawing Sheets

(56) References Cited

U.S. PATENT DOCUMENTS 6,154,619 A 11/2000 Boockholdt et al.
6,714,224 B2 3/2004 Yamanaka et al.
6,792,217 B2 9/2004 Nishino et al.
6,823,160 B2 11/2004 Okabe
6,829,465 B2 12/2004 Yamanaka et al.
6,903,759 B2 6/2005 Yamanaka et al.
6,909,866 B2 6/2005 Kawai
6,920,303 B2 7/2005 Yamanaka et al.
7,116,919 B2 10/2006 Ishii
7,130,551 B2 10/2006 Kobayashi
7,418,214 B2 8/2008 Yoshida et al.
7,463,834 B2 12/2008 Takagi et al.
7,509,075 B2 3/2009 Hayakawa
7,512,347 B2 3/2009 Suzuki et al.
7,536,117 B2 5/2009 Kishi
7,613,414 B2 11/2009 Kamimura
7,643,777 B2 1/2010 Matsumoto et al.
7,756,426 B2 7/2010 Kamimura
7,933,536 B2 4/2011 Ogawa
7,953,330 B2 5/2011 Ishikawa
8,010,026 B2 8/2011 Kobayashi et al.
RE42,796 E 10/2011 Ishii
8,090,272 B2 1/2012 Ishikawa
8,099,025 B2 1/2012 Ishikake
8,126,366 B2 2/2012 Hattori
8,417,130 B2 4/2013 Hashimoto
8,463,145 B2 6/2013 Ukai et al.
8,583,009 B2 * 11/2013 Takagi ..... G03G 15/0896 399/119
8,600,244 B2 12/2013 Hashimoto
8,620,180 B2 12/2013 Shiraki et al.
8,666,293 B2 3/2014 Mushika et al.
8,676,064 B2 * 3/2014 Takagi ..... G03G 15/0896 399/12
8,712,286 B2 * 4/2014 Takagi ..... G03G 15/0896 399/119
8,744,288 B2 6/2014 Shinoya et al.
8,761,643 B2 6/2014 Mushika et al.
8,849,133 B2 9/2014 Itabashi et al.
8,867,932 B2 10/2014 Ukai et al.
8,948,617 B2 2/2015 Shiraki et al.
8,948,661 B2 2/2015 Mushika et al.
9,195,207 B2 11/2015 Itabashi
9,207,567 B2 12/2015 Mushika et al.
2003/0185579 A1 10/2003 Nishino et al.
2003/0185594 A1 10/2003 Okabe
2003/0215265 A1 11/2003 Kawai
2006/0034625 A1 2/2006 Kajikawa
2006/0104670 A1 5/2006 Nishitani et al.
2006/0165423 A1 7/2006 Nishitani et al.
2006/0171737 A1 8/2006 Nishimura et al.
2006/0193643 A1 8/2006 Takagi et al.
2006/0193646 A1 8/2006 Suzuki et al.
2006/0245787 A1 11/2006 Ito et al.
2007/0031158 A1 2/2007 Kamimura
2007/0041747 A1 2/2007 Kim et al.
2007/0059018 A1 3/2007 Tokuda
2007/0059038 A1 3/2007 Shiraki
2007/0077101 A1 4/2007 Tamura et al.
2007/0122165 A1 5/2007 Igarashi et al.
2007/0140709 A1 6/2007 Yoshida et al.
2007/0140725 A1 6/2007 Kamimura
2007/0253748 A1 11/2007 Matsumoto et al.
2008/0080904 A1 4/2008 Murayama et al.
2008/0205911 A1 8/2008 Ishikawa et al.
2008/0205928 A1 8/2008 Ishikawa
2008/0205931 A1 8/2008 Ishikawa
2008/0223173 A1 9/2008 Ishikawa
2008/0317509 A1 12/2008 Mori
2009/0000423 A1 1/2009 Ishikawa et al.
2009/0052911 A1 2/2009 Richey et al.
2009/0084210 A1 4/2009 Tsukada et al.
2009/0169247 A1 7/2009 Hattori
2009/0257782 A1 10/2009 Ishikake
2009/0269085 A1 10/2009 Ukai
2009/0269086 A1 10/2009 Mikuni
2009/0285604 A1 11/2009 Nakajima
2009/0297226 A1 12/2009 Nagashima et al.
2010/0054763 A1 3/2010 Tomiyori et al.
2010/0209144 A1 8/2010 Nieda
2011/0023368 A1 2/2011 Mizutani et al.
2011/0038649 A1 * 2/2011 Miyabe et al. ..... 399/119
2011/0081163 A1 * 4/2011 Lee ..... 399/110
2011/0123231 A1 5/2011 Ozawa et al.
2011/0236062 A1 * 9/2011 Takagi ..... G03G 15/0896 399/119
2011/0236065 A1 * 9/2011 Takagi ..... 399/119
2011/0236066 A1 * 9/2011 Takagi ..... 399/119
2011/0243578 A1 * 10/2011 Ukai et al. ..... 399/12
2012/0014713 A1 1/2012 Murakami et al.
2012/0051795 A1 3/2012 Mushika et al.
2012/0057905 A1 3/2012 Itabashi
2012/0134688 A1 5/2012 Hashimoto
2012/0148297 A1 6/2012 Peng et al.
2012/0177398 A1 7/2012 Takigawa
2012/0243882 A1 9/2012 Carot
2012/0251165 A1 10/2012 Mushika et al.
2012/0251216 A1 10/2012 Mushika
2012/0321345 A1 12/2012 Shinoya et al.
2013/0051813 A1 2/2013 Itabashi et al.
2013/0051814 A1 2/2013 Itabashi et al.
2013/0051815 A1 2/2013 Itabashi et al.
2013/0051816 A1 2/2013 Itabashi
2013/0051833 A1 2/2013 Itabashi et al.
2013/0084083 A1 4/2013 Itabashi et al.
2013/0136460 A1 5/2013 Shiraki et al.
2013/0170844 A1 7/2013 Itabashi
2013/0170845 A1 7/2013 Itabashi
2013/0259528 A1 10/2013 Yamamoto
2013/0272724 A1 * 10/2013 Ukai et al. ..... 399/12
2014/0020489 A1 1/2014 Nozaki et al.
2014/0086638 A1 3/2014 Sato
2014/0169835 A1 6/2014 Nakajima
2014/0219690 A1 8/2014 Li et al.
2014/0294403 A1 10/2014 Shimizu
2014/0341617 A1 11/2014 Mushika et al.
2014/0363189 A1 12/2014 Hashimoto et al.
2014/0376968 A1 12/2014 Yamamoto et al.
2015/0000443 A1 1/2015 Shimizu
2015/0003844 A1 1/2015 Ukai et al.
2015/0005134 A1 1/2015 Shimizu
2015/0010334 A1 1/2015 Nakajima
2015/0037071 A1 2/2015 Yamamoto
2015/0043944 A1 2/2015 Yamamoto
2015/0104222 A1 4/2015 Mushika et al.
2015/0117873 A1 4/2015 Mori et al.
2015/0117906 A1 4/2015 Mori
2015/0153675 A1 6/2015 Itabashi et al.

FOREIGN PATENT DOCUMENTS

CN 1828447 A 9/2006
CN 1288515 C 12/2006
CN 2884266 Y 3/2007
CN 1983078 A 6/2007
CN 101063855 A 10/2007
CN 200962188 Y 10/2007
CN 101256379 A 9/2008
CN 101295157 A 10/2008
CN 201170840 Y 12/2008
CN 100476636 C 4/2009
CN 201222170 Y 4/2009
CN 101625537 B 1/2010
CN 201402371 Y 2/2010
CN 201464807 U 5/2010
CN 201489284 U 5/2010
CN 202102251 U 1/2012
CN 202472249 U 10/2012
CN 102799090 A 11/2012
CN 202649679 U 1/2013
CN 203673223 U 6/2014
EP 0838733 A2 4/1998
EP 1696278 A2 8/2006
EP 1696278 A3 8/2006

(56) References Cited

FOREIGN PATENT DOCUMENTS

| | | | |
|---|---|---|---|
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Dec. 11, 2012—(CN) Notification of the First Office Action with Search Report—App 201110251898.6.
Jan. 5, 2012—(JP) Decision of Patent Grant—App 2010-083408.
Jun. 26, 2012—(JP) Notice of Reasons for Rejection—App 2010-193204.
Sep. 18, 2012—(JP) Decision to Grant a Patent—App 2010-193204.
Feb. 19, 2013—(JP) Notice of Reasons for Rejection—App 2012-229560.
Oct. 16, 2013—(US) Notice of Allowance—U.S. Appl. No. 13/222,096.
Oct. 15, 2013—(CN) Office Action—App 201110251898.6.
Apr. 14, 2014—(US) Non-Final Office Action—U.S. Appl. No. 13/628,492.
Dec. 31, 2014—(CN) Notification of First Office Action—App 201310175410.5, Eng Tran.
Feb. 10, 2014—(US) Notice of Allowance—U.S. Appl. No. 14/154,521.
Feb. 27, 2014—(KR) Notice of Preliminary Rejection—App 10-2012-7028457.
Nov. 12, 2014—(US) Non-Final Office Action—U.S. Appl. No. 14/485,462.
Sep. 19, 2014—(US) Notice of Allowance—U.S. Appl. No. 14/275,251.
Sep. 23, 2014—(US) Notice of Allowance—U.S. Appl. No. 13/628,492.
Apr. 6, 2015—(US) Non-Final Office Action—U.S. Appl. No. 14/316,959.
Apr. 15, 2015—(US) Notice of Allowance—U.S. Appl. No. 14/529,221.
Apr. 21, 2015—(EP) Extended Search Report—App 14173865.8.
Aug. 4, 2015—(US) Notice of Allowance—U.S. Appl. No. 14/577,396.
Aug. 20, 2015—(EP) Extended EP Search Report in App No. 15161221.5.
Aug. 21, 2015—(EP) Extended Search Report—App 15161258.7.
Aug. 25, 2015—(US) Non-Final Office Action—U.S. Appl. No. 14/671,413.
Jul. 22, 2015—(US) Non-Final Office Action—U.S. Appl. No. 14/316,971.
Mar. 3, 2015—(CN) Notification of First Office Action—App 201310175229.4, Eng Tran.
Mar. 3, 2015—(CN) Notification of First Office Action—App 201310175264.6, Eng Tran.
Mar. 19, 2015—(US) Non-Final Office Action—U.S. Appl. No. 14/577,396.
Mar. 20, 2015—(US) Final Office Action—U.S. Appl. No. 14/485,462.
Mar. 27, 2015—(US) Co-pending U.S. Appl. No. 14/670,502.
Mar. 27, 2015—(US) Co-pending U.S. Appl. No. 14/670,676.
May 8, 2015—(US) Ex Parte Quayle—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.

(56) References Cited

OTHER PUBLICATIONS

Sep. 16, 2015—(US) Notice of Allowance—U.S. Appl. No. 14/485,462.
Sep. 17, 2015—(EP) Office Action—App 11179283.4.
Sep. 17, 2015—(EP) Office Action—App 11160291.8.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Co-pending U.S. Appl. No. 14/316,959, filed Jun. 27, 2014.
Co-Pending U.S. Appl. No. 14/316,971, filed Jun. 27, 2014.
Machine translation of JP 07-281519A dated May 2, 2013.
Machine translation of JP 10-031382A dated May 1, 2013.
Machine translation of JP 2006-235236 dated Jan. 9, 2014.
Oct. 19, 2015—(US) Non-Final Office Action—U.S. Appl. No. 14/611,393.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US) Non-Final Office Action—U.S. Appl. No. 14/926,345.
Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP ) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb. 25, 2016—(US) Non-Final Office Action—U.S. Appl. No. 14/316,959.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 14, 2016—(US) Notice of Allowance—U.S. Appl. No. 14/670,522.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
Feb. 2, 2016—(US) Notice of Allowance—U.S. Appl. No. 14/670,516.
Feb. 17, 2016—(US) Notice of Allowance—U.S. Appl. No. 14/671,413.
Feb. 18, 2016—(US) Notice of Allowance—U.S. Appl. No. 14/529,221.
Mar. 29. 2016—(US) Notice of Allowance—U.S. Appl. No. 14/485,462.
Apr. 1, 2016—(US) Notice of Allowance—U.S. Appl. No. 14/926,345.
Apr. 12, 2016—(US) Notice of Allowance—U.S. Appl. No. 14/611,393.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690A.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
Aug. 1, 2016—(US) Notice of Allowance—U.S. Appl. No. 14/670,516.
Jul. 15, 2016—(US) Notice of Allowance—U.S. Appl. No. 14/670,522.
Sep. 12, 2016—(US) Notice of Allowance—U.S. Appl. No. 14/589,696.
Sep. 28, 2016—(US) Notice of Allowance—U.S. Appl. No. 14/670,801.
Aug. 9, 2016—(US) Notice of Allowance—U.S. Appl. No. 15/079,829.
Jul. 14, 2016—(US) Notice of Allowance—U.S. Appl. No. 14/670,676.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

IMAGE FORMING DEVICE

CROSS-REFERENCE TO RELATED APPLICATION

This application claims priority from Japanese Patent Application No. 2013-195539, filed on Sep. 20, 2013, which is incorporated herein by reference in its entirety.

TECHNICAL FIELD

Aspects disclosed herein relate to an image forming apparatus which employs electrophotography.

BACKGROUND

There have been known electrophotographic apparatuses such as printers where developing cartridges are detachably mounted. Such electrophotographic apparatuses have new/old detection mechanisms to determine information of a mounted cartridge.

For example, an electrophotographic apparatus includes an apparatus main body having an actuator and new/old detection sensor, and a photosensitive drum unit detachably mounted to the apparatus main body. The photosensitive drum unit includes a detection piece gear and an idle gear.

This electrophotographic apparatus operates such that a driving force is transmitted to the detection piece gear via the idle gear. This rotates the detection piece gear, so that an action-imparting piece interferes with an action-receiving piece of the actuator, and moves the actuator. The new/old sensor detection the movement of the actuator, and the electrophotographic apparatus determines information of the photosensitive drum unit.

SUMMARY

However, because the photosensitive drum unit is detachably mounted to the apparatus main body, it may be difficult to improve the relative positional precision between the photosensitive drum unit and the apparatus main body when mounting the photosensitive drum unit.

Accordingly, the new/old detection sensor may not accurately detect movement of the apparatus main body, and detection precision of the photosensitive drum unit may be reduced.

Accordingly, it is an object of the present invention to provide an image forming apparatus of which detection precision of cartridge such as photosensitive drum, developing cartridge and toner cartridge can be improved.

According to one or more aspects of the disclosure, an image forming apparatus may include an apparatus main body and a cartridge configured to be mounted to and detached from the apparatus main body. The cartridge may include a rotating member which is configured to rotate and comprises a detected portion and a first engaging portion. The apparatus main body may include a detecting portion configured to detect the detected portion and a second engaging portion configured to engage with the first engaging portion. At least when the detecting portion detects the detected portion, the first engaging portion and the second engaging portion are engaged with each other by rotation of the rotating member.

DETAILED DESCRIPTION

1. Overall Configuration of Printer

Figure 1:
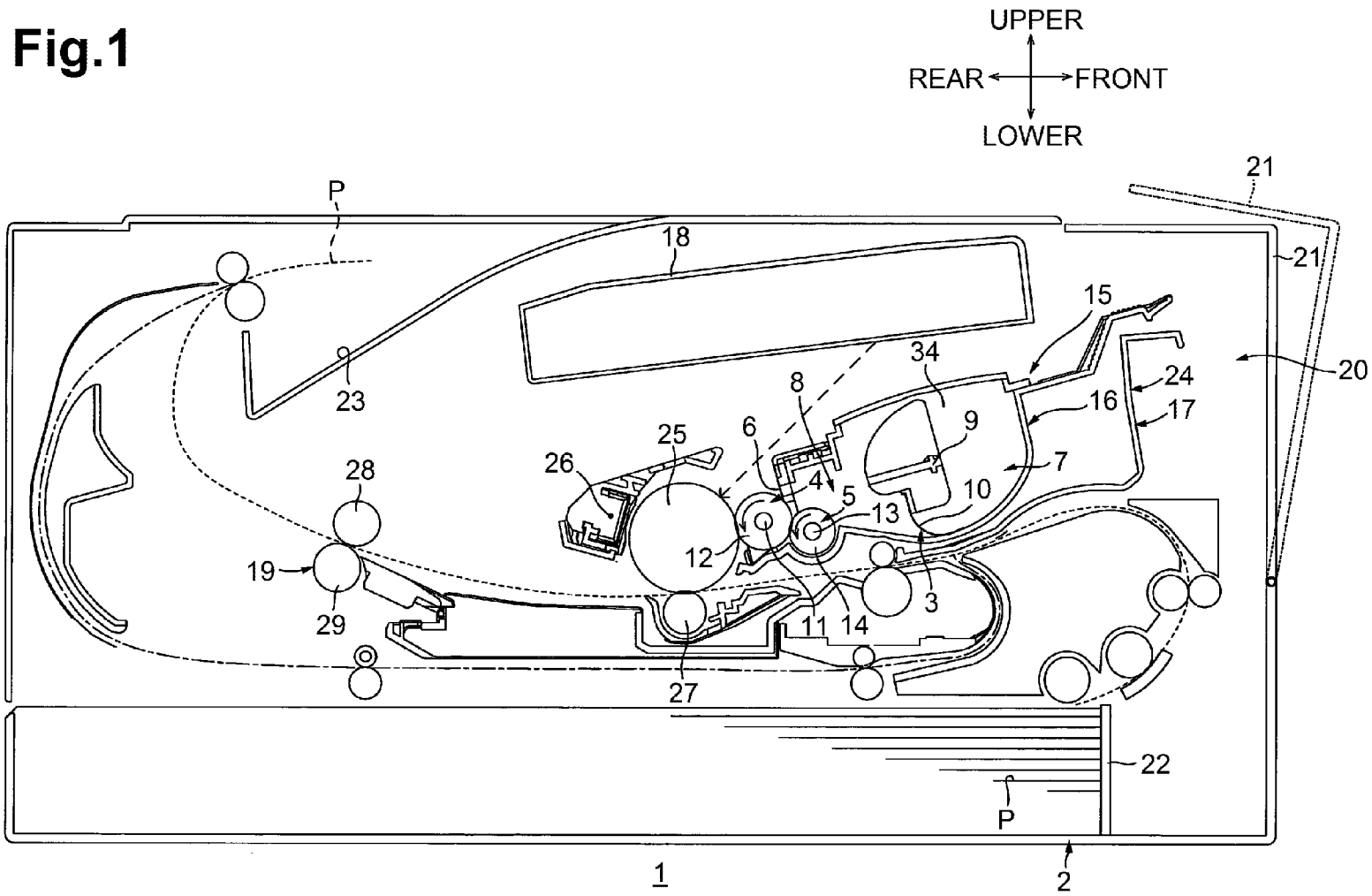
FIG. 1 is a cross-sectional view taken along the middle of a printer according to a first embodiment of an electrophotographic apparatus according to the present embodiment.

A printer 1 which is an example of an image forming apparatus is an electrophotographic black-and-white printer, as illustrated in FIG. 1. The printer 1 includes a main body casing 2 which is an example of an apparatus main body, a process cartridge 17, a scanner unit 18, and a fixing unit 19.

The main body casing 2 has a general box shape. The main body casing 2 has an opening portion 20, a front cover 21, a sheet feed tray 22, and a sheet discharge tray 23.

Note that in the following description, when referring to directions, in FIG. 1 the right side in the plane of the drawing is the front, and the left side in the plane of the drawing is the rear, based on a state where the printer 1 is installed flat and level. Based on the left and right when viewing the printer 1 from the front, the near side in the drawing in FIG. 1 is the left side, and the far side in the drawing is the right side. Further, the front-back, left-right, and up-down directions are stipulated regarding a later-described developing cartridge 15, based on the mounted state to the main body casing 2. This is illustrated in detail by the arrows in the drawings. The left-right direction is one example of an axial line direction, with an axial line direction from the right side toward the left side being a first direction, and an axial line direction from the left side toward the right side being a second direction.

The opening portion 20 is configured such that the front wall of the main body casing 2 is opened in the front-back direction, allowing passage of the process cartridge 17, as illustrated in FIG. 1.

The front cover 21 has a plate form, generally L-shaped in side view. The front cover 21 is supported by the lower edge thereof as a pivot so was to be capable of rocking as to the front wall of the main body casing 2. The front cover 21 is configured so as to open or close the opening portion 20.

The sheet feed tray 22 is disposed on the bottom of the main body casing 2, and is configured to store sheets P.

The sheet discharge tray 23 is disposed on the upper face of the main body casing 2.

The process cartridge 17 is configured to be mounted to and detached from the main body casing 2, via the opening portion 20. The process cartridge 17 includes a drum cartridge 24 and the developing cartridge 15 which is an example of a cartridge.

The drum cartridge 24 includes a photosensitive drum 25, a scorotron charger 26, and a transfer roller 27.

The photosensitive drum 25 has a generally cylindrical shape extending on the left-right direction, and is rotatably supported at the rear end of the drum cartridge 24 by the frame thereof.

The scorotron charger 26 is disposed behind the photosensitive drum 25, with spacing provided between the photosensitive drum 25 and scorotron charger 26.

The transfer roller 27 is disposed beneath the photosensitive drum 25. The top portion of the transfer roller 27 comes into contact with the bottom portion of the photosensitive drum 25.

The developing cartridge 15 is configured so as to be mounted to and detached from the drum cartridge 24. Thus, the developing cartridge 15 is configured so as to be mounted to and detached from the main body casing 2.

The developing cartridge 15 includes a housing 16, an agitator 3, a developing roller 4, a supply roller 5, and a layer thickness regulating blade 6.

Figure 2:
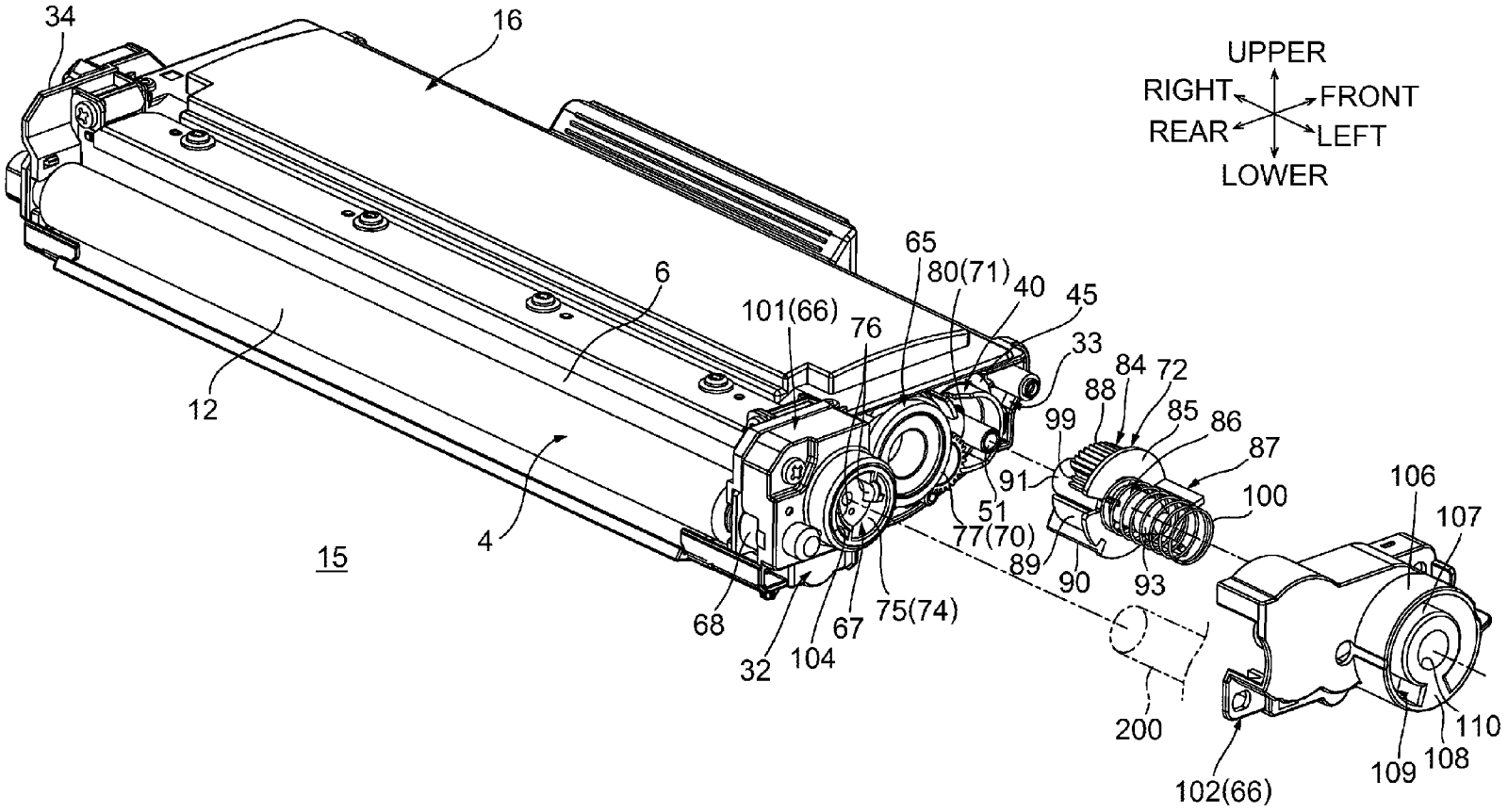
FIG. 2 is a disassembled perspective view of a developing cartridge illustrated in FIG. 1 as viewed from the upper left side.

The housing 16 is in a generally box form extending in the left-right directions, with the rear end portion of the housing 16 opened in the front-back direction, as illustrated in FIG. 2. The housing 16 includes a toner accommodation chamber 7 and a developing chamber 8 therein, disposed in parallel in the front-back direction, as illustrated in FIG. 1. The toner accommodation chamber 7 accommodates toner.

The agitator 3 is disposed around the middle portion of the toner accommodation chamber 7 in the front-back and vertical directions. The agitator 3 has an agitator shaft 9 and a stirring blade 10. The agitator shaft 9 has a general columnar shape extending in the left-right direction. The stirring blade 10 extends outwards from the agitator shaft 9, in the radial direction of the agitator shaft 9.

The agitator 3 is supported by the housing 16, by the left and right end portions of the agitator shaft 9 being rotatably supported by a later-described left wall 33 and right wall 34. The left end portion of the agitator shaft 9 passes through the later-described left wall 33 and protrudes to the left side, as illustrated in FIG. 4A.

Figure 13:
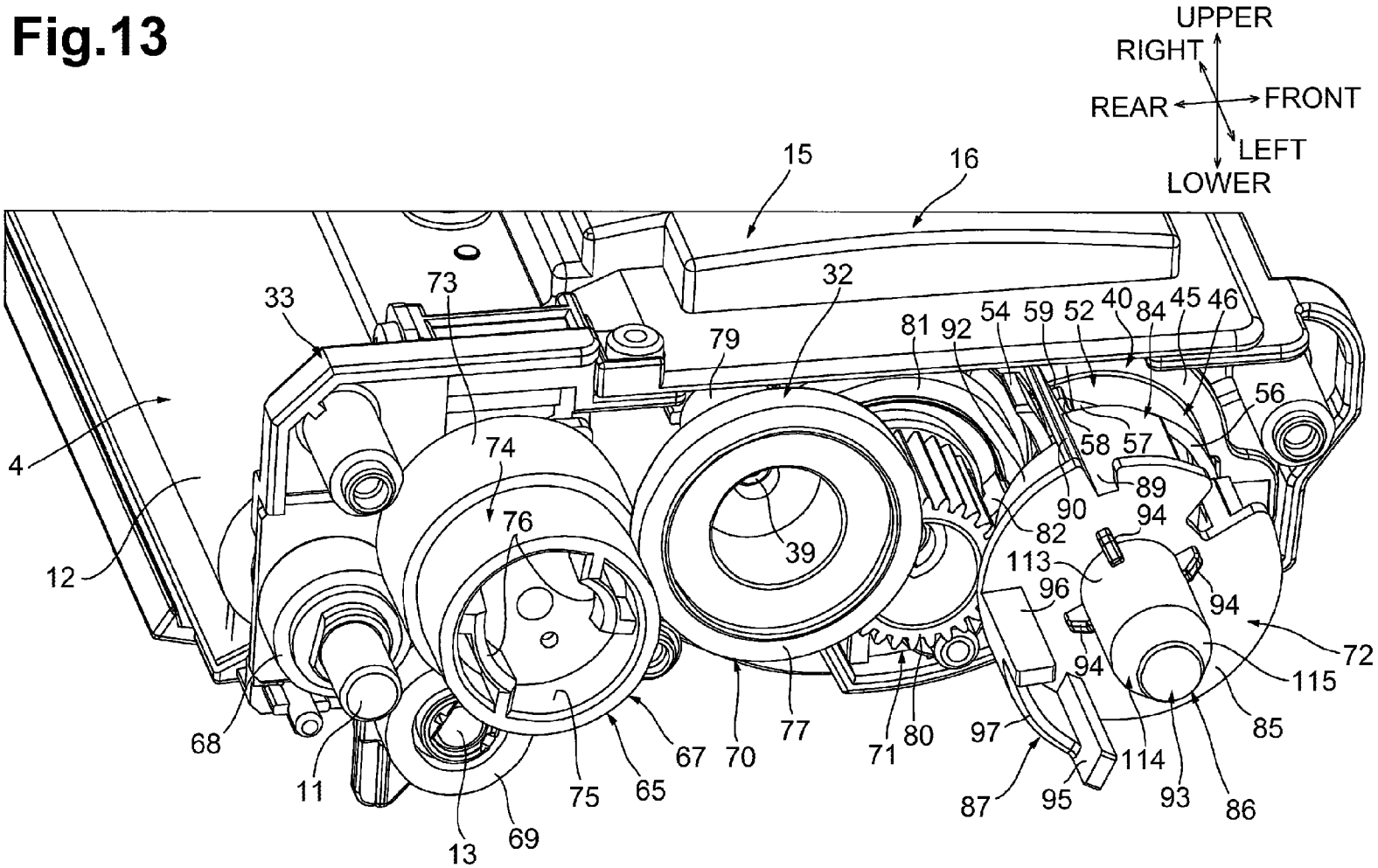
FIG. 13 is a perspective view of the detection unit illustrated in FIG. 12A as viewed from the upper left side.

The developing roller 4 is disposed at the rear end portion of the developing chamber 8, as illustrated in FIG. 1. The developing roller 4 includes a developing roller shaft 11 and a rubber roller 12. The developing roller shaft 11 has a generally columnar form extending in the left-right direction. The rubber roller 12 covers the developing roller shaft 11 so that both the left and right end portions of the developing roller shaft 11 are exposed. The upper portion and rear portion of the rubber roller 12 of the developing roller 4 are exposed from the housing 16. The developing roller 4 is supported by the housing 16, by the left and right end portions of the developing roller shaft 11 being rotatably supported by the later-described left wall 33 and right wall 34. The left end portion of the developing roller shaft 11 passes through the later-described left wall 33 and protrudes to the left side, as illustrated in FIG. 13.

The supply roller 5 is disposed at the lower front side of the developing roller 4 within the developing chamber 8, as illustrated in FIG. 1. The supply roller 5 includes a supply roller shaft 13 and a sponge roller 14. The supply roller shaft 13 has a generally columnar form extending in the left-right direction. The sponge roller 14 the supply roller shaft 13 so that both the left and right end portions of the supply roller shaft 13 are exposed. The upper rear portion of the sponge roller 14 of the supply roller 5 is pressed against the lower front portion of the rubber roller 12. The supply roller 5 is supported by the housing 16, by the left and right end portions of the supply roller shaft 13 being rotatably supported by the later-described left wall 33 and right wall 34. The left end portion of the supply roller shaft 13 passes through the later-described left wall 33 and protrudes to the left side, as illustrated in FIG. 13.

The layer thickness regulating blade 6 is disposed to the upper front of the developing roller 4 within the developing chamber 8. The layer thickness regulating blade 6 has a plate shape, generally rectangular in rear view that extends in the left-right direction, and extends in the vertical direction in side view. The layer thickness regulation blade 6 is supported by the housing 16 so that the lower edge portion of the layer thickness regulating blade 6 comes into contact with the upper front portion of the developing roller 4.

The rear portion of the developing roller 4 is in contact with the front portion of the photosensitive drum 25 in a state where the developing cartridge 15 is mounted to the drum cartridge 24.

A scanner unit 18 is disposed above the process cartridge 17. The scanner unit 18 is configured to emit a laser beam toward the photosensitive drum 25, based on image data, as illustrated by a dashed line in FIG. 1.

The fixing unit 19 is disposed behind the process cartridge 17. The fixing unit 19 includes a heating roller 28 and a pressure roller 29. The pressure roller 29 is disposed to the lower rear of the heating roller 28, and is pressed against the lower rear portion of the heating roller 28.

Upon the printer 1 starting image forming operations under control of a control unit omitted from illustration, the scorotron charger 26 uniformly charges the surface of the photosensitive drum 25. Thereafter, the scanner unit 18 exposes the surface of the photosensitive drum 25. Thus, an electrostatic latent image based on the image data is formed on the surface of the photosensitive drum 25.

The agitator 3 stirs toner within the toner accommodation chamber 7, so as to be supplied to the supply roller 5. The supply roller 5 supplies the toner supplied from the agitator 3 to the developing roller 4. At this time, the toner is charged by friction to a positive polarity between the developing roller 4 and the supply roller 5, and is borne by the developing roller 4. The layer thickness regulating blade 6 regulates the thickness of the toner layer borne on the developing roller 4 to a constant thickness.

The toner borne by the developing roller 4 is then supplied to the electrostatic latent image on the surface of the photosensitive drum 25. Accordingly, a toner image is borne on the surface of the photosensitive drum 25.

Sheets P are fed one at a time from the sheet feed tray 22, at predetermined timings, by rotation of various rollers, and fed to the nip of the photosensitive drum 25 and transfer roller 27. The toner image on the photosensitive drum 25 is transferred to the sheet P when passing between the photosensitive drum 25 and the transfer roller 27.

Thereafter, the sheet P is heated and pressurized when passing between the heating roller 28 and the pressure roller 29. The toner image on the sheet P is thermally fixed to the sheet P at this time. Thereafter, the sheet P is discharged to the sheet discharge tray 23.

2. Details of Developer Cartridge

The developing cartridge 15 has a detection unit 32 disposed to the left of the housing 16, as illustrated in FIG. 2.

(1) Housing

The housing 16 includes a left wall 33 and a right wall 34, which are examples of wall portions. The left wall 33 is disposed providing space to the left side of the right wall 34.

The left wall 33 and right wall 34 each have a plate shape, generally rectangular in side view and extending in the front-back direction.

Figure 4B:
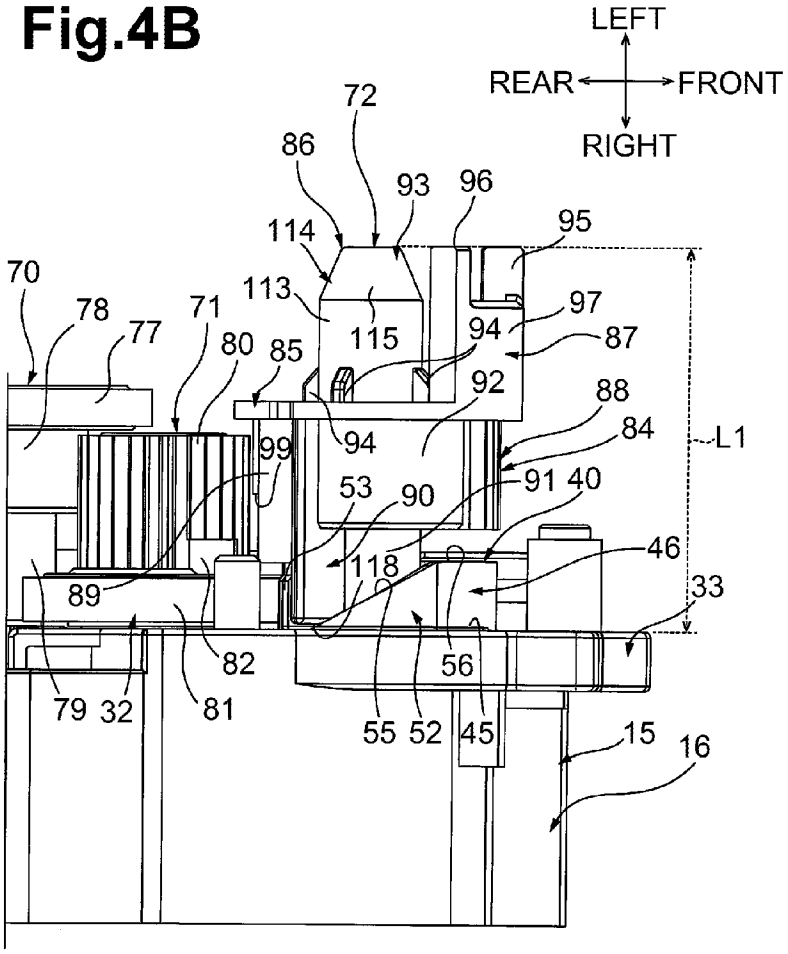
FIG. 4B is a bottom view of the detection unit illustrated in FIG. 4A.
Figure 4A:
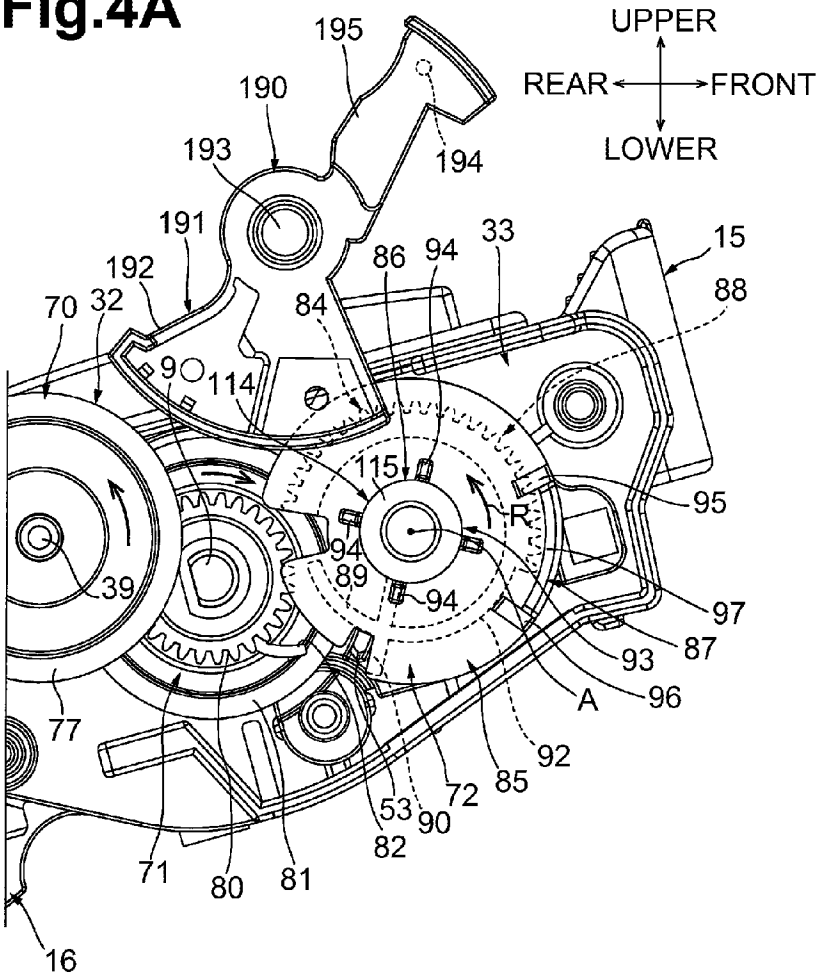
FIG. 4A is an explanatory diagram for describing a new-product detection operation by a detection unit illustrated in FIG. 2, illustrating a state in which a detection gear is in an initial position, as viewed from the left side.
Figure 5:
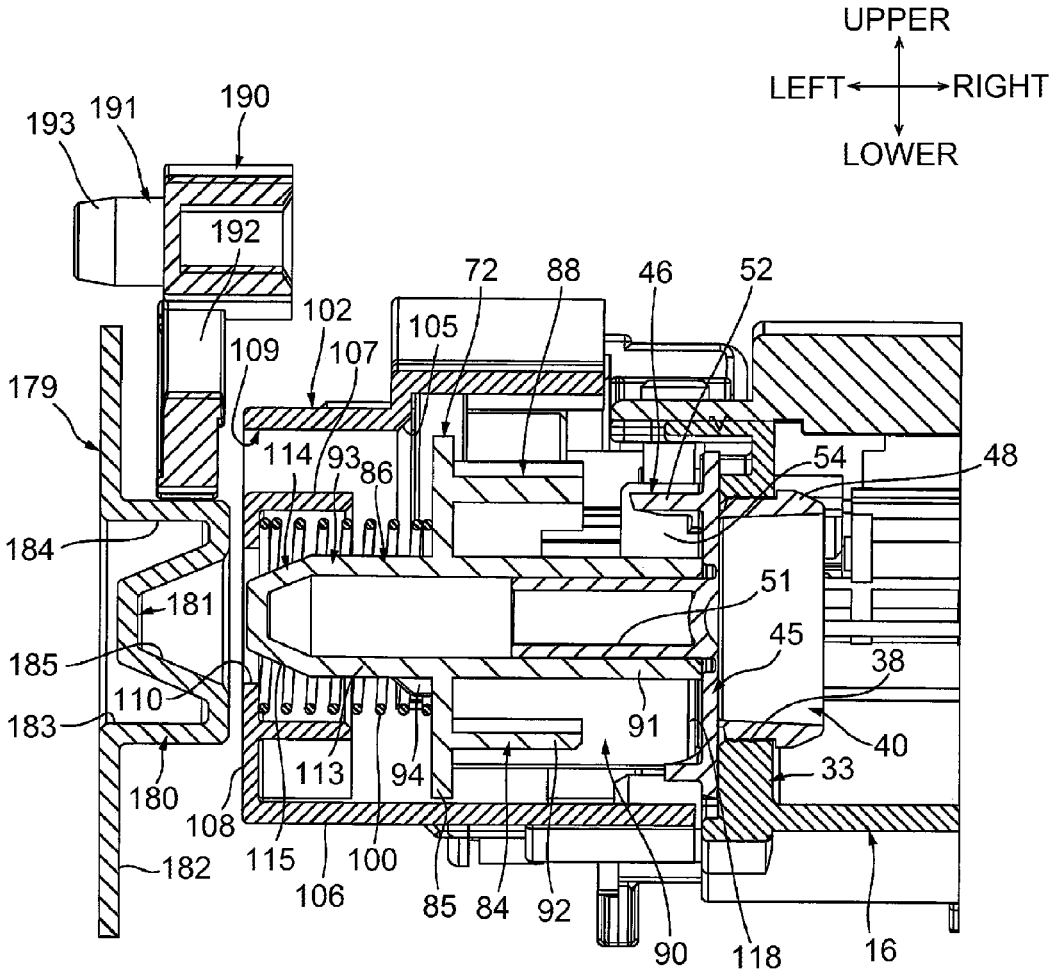
FIG. 5 is a cross-sectional view of the detection unit and engaging unit illustrated in FIG. 4A, taken in a radial direction of a boss.

The left wall 33 has an idle gear supporting shaft 39, a toner replenishing opening 38, and a cap 40, as illustrated in FIGS. 4A and 5.

The idle gear supporting shaft 39 is disposed in the generally middle portion of the left face of the left wall 33 in the front-back direction, and is disposed to the upper rear of the left end portion of the agitator shaft 9 exposed from the left wall 33, as illustrated in FIG. 4A. The idle gear supporting shaft 39 has a general columnar shape, extending in the left-right direction, and protruding from the left face of the left wall 33 to the left.

The toner replenishing opening 38 is disposed to the front of the left end portion of the agitator shaft 9 exposed form the left wall 33, and passes through the front end portion of the left wall 33 in the left-right direction, as illustrated in FIG. 5. Thus, the toner replenishing opening 38 realizes communication between the toner accommodation chamber 7 and the external space outside of the housing 16, in the left-right direction.

Figure 3A:
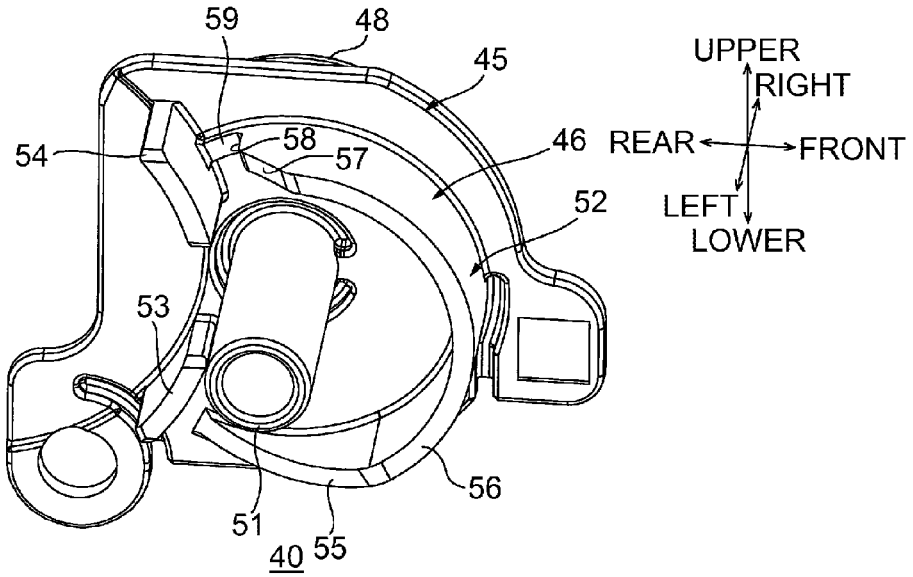
FIG. 3A is a perspective view of a cap illustrated in FIG. 2 from the upper left side.

The cap 40 is configured to be detachably mounted to the toner replenishing opening 38. The cap 40 integrally includes a closure portion 45, an insertion portion 48, and a detection gear supporting portion 46, as illustrated in FIG. 3A.

The closure portion 45 is a plate shape, generally rectangular in side view. The insertion portion 48 is disposed to the right face of the closure portion 45, as illustrated in FIG. 5. The insertion portion 48 is a general cylinder shape extending in the left-right direction, and protrudes to the right from the right face of the closure portion 45. The outer diameter of the insertion portion 48 is slightly smaller than the inner diameter of the toner replenishing opening 38.

The detection gear supporting portion 46 is disposed on the left face of the closure portion 45. The detection gear supporting portion 46 includes a detection gear supporting shaft 51, a guide portion 52, a first stopper 53, and a second stopper 54, as illustrated in FIG. 3A.

The detection gear supporting shaft 51 is disposed on the left face of the closure portion 45 at around the middle portion. The detection gear supporting shaft 51 has a general columnar shape, extending in the left-right direction, and protrudes to the left from the left face of the closure portion 45.

The guide portion 52 has a general C-shape in side view, opened toward the rear, and has a general half-pipe shape extending in the left-right direction. The guide portion 52 protrudes to the left from the left face of the closure portion 45. The guide portion 52 is disposed to surround the detection gear supporting shaft 51 from the front, with a spacing provided as to the outer perimeter face of the detection gear supporting shaft 51.

The guide portion 52 has a first inclined surface 55, a first parallel face 56, a second inclined surface 57, a notched face 58, and a second parallel face 59.

The first inclined surface 55 is disposed at the upstream end portion in the counterclockwise direction in left view, at the left face of the guide portion 52. The first inclined surface 55 is continuous with the left face of the closure portion 45, and is inclined toward the left as proceeding downstream in the counterclockwise direction in left view.

The first parallel face 56 continues from the downstream end portion of the first inclined surface 55 in the counterclockwise direction in left view, and extends in the counterclockwise direction in left view so as to be parallel to the left face of the closure portion 45.

The second inclined surface 57 continues from the downstream end portion of the first parallel face 56 in the counterclockwise direction in left view, and is inclined toward the right as proceeding downstream in the counterclockwise direction in left view.

The notched face 58 is notched from the downstream end portion of the second inclined surface 57 in the counterclockwise direction in left view, toward the right.

The second parallel face 59 continues from the right end portion of the notched face 58, and extends in the counterclockwise direction in left view, so as to be parallel to the left face of the closure portion 45.

The first stopper 53 is disposed with a spacing behind the upstream end portion of the guide portion 52 in the counterclockwise direction in left view. The first stopper 53 has a plate shape and extends following the peripheral direction of rotation of a later-described second gear portion 81, and protrudes to the left from the left face of the closure portion 45.

The second stopper 54 is disposed with a spacing behind the notched face 58 of the guide portion 52. The second stopper 54 has a plate shape and extends following the peripheral direction of rotation of the later-described second gear portion 81, and protrudes to the left from the left face of the closure portion 45.

The cap 40 is mounted to the left wall 33 by the insertion portion 48 being inserted to the toner replenishing opening 38, as illustrated in FIG. 5. Accordingly, the closure portion 45 of the cap 40 closes the toner replenishing opening 38 from the left.

(2) Detection Unit

The detection unit 32 is disposed to the left of the left wall 33 as illustrated in FIG. 2, and has a gear train 65, a spring member 100, and a cover member 66.

(2-1) Gear Train

The gear train 65 includes a developing coupling 67, a developing gear 68, a supply gear 69, an idle gear 70, an agitator gear 71, and a detection gear 72 which is an example of a rotating member, as illustrated in FIG. 13.

(2-1-1) Developing Coupling, Developing Gear, and Supply Gear

The developing coupling 67 is disposed on the rear portion of the left face of the left wall 33, as illustrated in FIG. 13. The developing coupling 67 is supported by the left wall 33 so as to be rotatable on an unshown rotation shaft. The unshown rotation shaft is fixed to the left wall 33 and extends in the left-right direction, and is incapable of relative rotation.

The developing coupling 67 has a general columnar shape extending in the left-right direction, and integrally includes a coupling gear portion 73 and a coupling portion 74.

The coupling gear portion 73 is the right portion of the developing coupling 67, and has gear cogs over the entire perimeter thereof.

The coupling portion 74 is the left portion of the developing coupling 67, and has a general columnar shape of which the center axial line matches that of the coupling gear portion 73. The outer diameter of the coupling portion 74 is smaller than the outer diameter of the coupling gear portion 73.

The coupling portion 74 also has a linking recess portion 75 and a pair of protruding structures 76.

The linking recess portion 75 is formed at the left end face of the coupling portion 74. The linking recess portion 75 has a general cylinder shape in side view, and is recessed from the left end face of the coupling portion 74 toward the right.

The pair of protruding structures 76 are disposed within the linking recess portion 75 and face one another in the radial direction of the linking recess portion 75. Each protruding structure 76 protrudes inward in the radial direction toward the center of the linking recess portion 75 from the inner perimeter face of the linking recess portion 75. The protruding structures 76 have general square column shapes extending in the left-right direction.

The developing gear 68 is disposed to the lower rear of the developing coupling 67. The developing gear 68 has a general cylinder shape extending in the left-right direction, and has gear cogs formed on the entire perimeter face thereof.

The developing gear 68 is attached to the left end portion of the developing roller shaft 11 so as to be incapable of relative rotation. The upper front portion of the developing gear 68 meshes with the lower rear portion of the coupling gear portion 73.

The supply gear 69 is disposed below the developing coupling 67. The supply gear 69 has a general cylinder shape extending in the left-right direction, and has gear cogs formed on the entire perimeter face thereof.

The supply gear 69 is attached to the left end portion of the supply roller shaft 13 so as to be incapable of rotation. The top of the supply gear 69 meshes with the bottom of the coupling gear portion 73.

(2-1-2) Idle Gear and Agitator Gear

The idle gear 70 is disposed to the front of the developing coupling 67. The idle gear 70 has a large-diameter gear 77, an intermediate portion 78, and a small-diameter gear 79, as illustrated in FIG. 4B.

The large-diameter gear 77 is disposed to the left end portion of the idle gear 70, and is formed as a general ring shaped plate having thickness in the left-right direction, as illustrated in FIG. 4A. The large-diameter gear 77 has gear cogs formed over the entire perimeter face thereof.

The intermediate portion 78 has a general cylinder shape of which the center axial line matches that of the large-diameter gear 77, and protrudes to the right from the right face of the large-diameter gear 77, as illustrated in FIG. 4B. The outer diameter of the intermediate portion 78 is smaller than the outer diameter of the large-diameter gear 77, and the inner diameter of the intermediate portion 78 is generally the same as the inner diameter of the large-diameter gear 77. The right end face of the intermediate portion 78 is closed off.

The small-diameter gear 79 has a general cylinder shape of which the center axial line matches that of the intermediate portion 78, and protrudes to the right from the right face of the intermediate portion 78. The outer diameter of the small-diameter gear 79 is smaller than the outer diameter of the intermediate portion 78, and the inner diameter of the small-diameter gear 79 is slightly larger than the outer diameter of the idle gear supporting shaft 39, as illustrated in FIG. 4A. The small-diameter gear 79 has gear cogs formed over the entire perimeter face thereof.

The small-diameter gear 79 of the idle gear 70 accepts the idle gear supporting shaft 39 so as to be incapable of relative rotation, and thus the idle gear 70 is rotatably supported on the left wall 33. The rear portion of the large-diameter gear 77 of the idle gear 70 meshes with the front portion of the coupling gear portion 73, as illustrated in FIG. 13.

The agitator gear 71 is disposed to the lower front of the idle gear 70. As illustrated in FIG. 4B, the agitator gear 71 integrally includes a first gear portion 80, a second gear portion 81, and a first abutting portion 82.

The first gear portion 80 is the left portion of the agitator gear 71, and has a general cylinder shape extending in the left-right direction. The first gear portion 80 has gear cogs formed over the entire perimeter face thereof.

The second gear portion 81 is the right portion of the agitator gear 71, and is adjacent to the first gear portion 80 at the right thereof. The second gear portion 81 is formed as a general ring shaped plate, with the center axial line matching that of the first gear portion 80. The outer diameter of the second gear portion 81 is greater than the outer diameter of the first gear portion 80. The second gear portion 81 has gear cogs formed over the entire perimeter face thereof.

The first abutting portion 82 is disposed to the left face of the second gear portion 81. The first abutting portion 82 is formed as a plate protruding to the left from the left face of the second gear portion 81, and protrudes further toward the left than the gear cogs of the second gear portion 81. The first abutting portion 82 extends inclined in the counterclockwise direction in left side view, as to the radial direction of rotation of the agitator gear 71, as illustrated in FIG. 4A. Further, an inner end portion of the second gear portion 81 in the radial direction is connected to a right end portion on the outer perimeter face of the first gear portion 80.

The agitator gear 71 is attached to the left end portion of the agitator shaft 9 so as to be incapable of relative rotation. Accordingly, the agitator gear 71 is rotatable as to the left wall 33 with the center axial line of the agitator shaft 9 as the center of rotation.

The rear portion of the second gear portion 81 of the agitator gear 71 meshes with the front portion of the small-diameter gear 79 of the idle gear 70, as illustrated in FIG. 4B. The rear portions of the first gear portion 80 and second gear portion 81 are each disposed as to the front portion of the large-diameter gear 77 such that there is space therebetween at the right of the large-diameter gear 77. When projected in the left-right direction, the rear portions of the first gear portion 80 and second gear portion 81 overlap the front portion of the large-diameter gear 77.

(2-1-3) Detection Gear

The detection gear 72 is disposed to the front of the agitator gear 71, as illustrated in FIG. 13. Note that the detection gear 72 rotates irreversibly from an initial position to a destination position via an advanced position under driving force transmitted from the agitator gear 71, following a rotation direction R, as illustrated in FIGS. 4A, 10A, and 12A, which will be described in detail later. Note that the rotation direction R is in the counterclockwise direction in left view, as indicated by the arrow in FIG. 4A.

Now, description will be made below regarding the detection gear 72, assuming that the detection gear 72 is in the initial position illustrated in FIGS. 4A through 5.

The detection gear 72 is formed of a known plastic. The detection gear 72 integrally includes a plate portion 85, a shaft insertion portion 91, a drive receiving portion 84, a first engaging portion 86, and a detected portion 87, as illustrated in FIG. 3B.

The plate portion 85 is a generally disc-shaped plate in side view. The outer diameter of the plate portion 85 is larger than the outer diameter of the second gear portion 81, as illustrated in FIG. 4A.

Figure 3B:
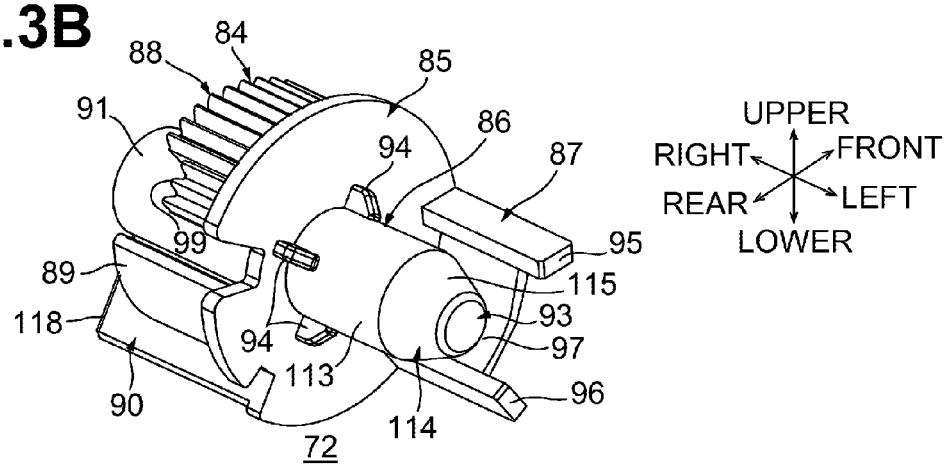
FIG. 3B is a perspective view of a gear illustrated in FIG. 2 from the left rear side.

The shaft insertion portion 91 is disposed to the right face of the plate portion 85, as illustrated in FIG. 3B. The shaft insertion portion 91 has a general cylinder shape of which the center axial line matches that of the plate portion 85, and protrudes toward the right from the middle portion of the plate portion 85 in the radial direction. The inner diameter of the shaft insertion portion 91 is generally the same as the outer diameter of the detection gear supporting shaft 51.

The drive receiving portion 84 is disposed on the right face of the plate portion 85, and integrally includes a detection gear portion 88, a guide rib 90, a connecting portion 92, and a second abutting portion 89.

The detection gear portion 88 has a half-cylinder shape of which the center axial line matches that of the plate portion 85 as illustrated in FIGS. 3B and 4A, and is opened downwards in side view. The detection gear portion 88 protrudes to the right from the right face of the plate portion 85 as illustrated in FIG. 3B. The detection gear portion 88 has gear cogs formed over the entire perimeter face thereof.

The radius of curvature of the detection gear portion 88 is smaller than the outer diameter of the plate portion 85, as illustrated in FIG. 4A. Accordingly, the outer perimeter edge of the plate portion 85 is situated further inward as compared to the gear cogs on the outer perimeter of the detection gear portion 88, in terms of the radial direction of rotation of the detection gear 72.

The detection gear portion 88 is disposed so as to surround the upper front portion of the shaft insertion portion 91, with space provided therebetween at the upper front portion of the outer perimeter face of the shaft insertion portion 91, as illustrated in FIG. 3B.

The detection gear portion 88 also has a notch 99. The notch 99 is situated at the right portion of the detection gear portion 88 at the downstream end in the rotation direction R. The notch 99 is rectangular in shape in rear view, the right portion of the detection gear portion 88 at the downstream end in the rotation direction R having been notched out.

The guide rib 90 is disposed to the lower rear of the shaft insertion portion 91. The guide rib 90 has a general plate shape, and extends in the radial direction of rotation of the detection gear 72 as illustrated in FIG. 4A. An inner end portion of the guide rib 90 in the radial direction is connected to the lower rear edge of the shaft insertion portion 91. The left end portion of the guide rib 90 is connected to the right face of the plate portion 85. The left-right direction dimensions of the guide rib 90 are longer than the left-right direction dimensions of the detection gear portion 88, as illustrated in FIG. 4B.

Figure 6B:
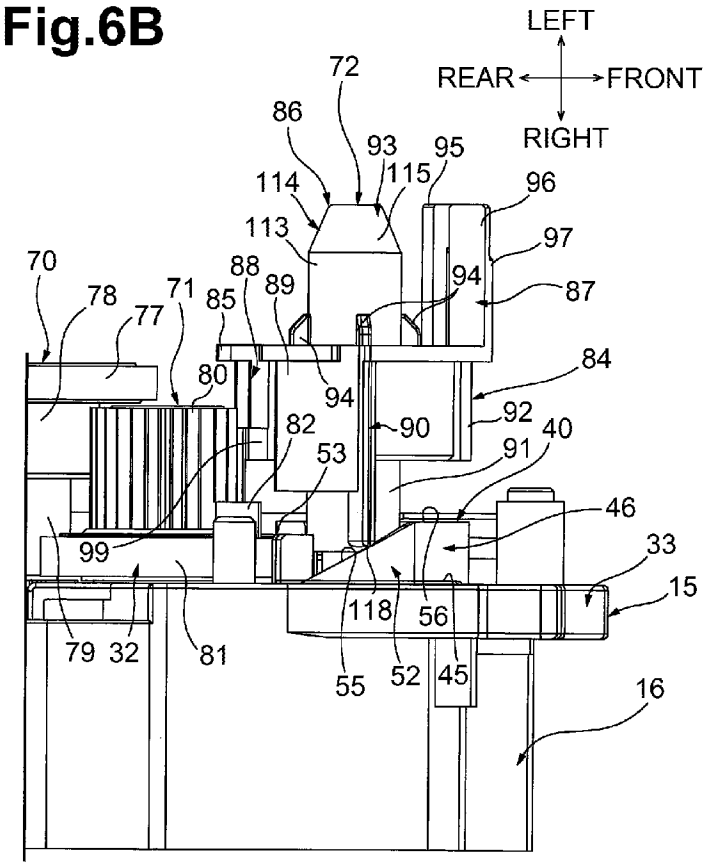
FIG. 6B is a bottom view of the detection unit illustrated in FIG. 6A.

A sliding portion 118 is formed at the right end portion of the guide rib 90. The sliding portion 118 is chamfered to form a half-arc bulging toward the right, as viewed from the direction in which the guide rib 90 extends following the radial direction of rotation of the detection gear 72, as illustrated in FIG. 6B.

The connecting portion 92 is disposed to the lower front of the shaft insertion portion 91 with space therebetween, as illustrated in FIG. 4A, so as to link the upstream end portion of the detection gear portion 88 in the rotational direction R and the middle portion of the front face of the guide rib 90 in the radial direction, along the rotational direction R of the detection gear 72. The connecting portion 92 protrudes to the right from the right face of the plate portion 85. The left-right direction dimensions of the connecting portion 92 are generally the same as the left-right direction dimensions of the detection gear portion 88.

The second abutting portion 89 is disposed to the lower rear of the shaft insertion portion 91 with space provided therebetween, as illustrated in FIG. 3B, so as to be disposed upstream of the guide rib 90 in the rotational direction R. The second abutting portion 89 has a general arc shape in side view that extends along the rotational direction R, and extends from the general middle portion of the guide rib 90 in the radial direction toward the upstream in the rotational direction R, as illustrated in FIG. 4A. The second abutting portion 89 protrudes to the right from the right face of the plate portion 85, as illustrated in FIG. 3B. The left-right direction dimensions of the second abutting portion 89 are longer than the left-right direction dimensions of the detection gear portion 88 but shorter than the left-right direction dimensions of the guide rib 90, as illustrated in FIG. 4B.

The first engaging portion 86 is disposed to the left face of the plate portion 85 as illustrated in FIG. 3B, and includes an engaging boss 93 which is an example of a columnar member, and multiple retaining protrusions 94.

The engaging boss 93 has a general columnar shape of which the center axial line matches that of the plate portion 85, and protrudes toward the left from the generally middle portion in the radial direction of the plate portion 85. More specifically, the engaging boss 93 has a base end portion 113 and a tip end portion 114. The base end portion 113 has a general columnar shape extending in the left-right direction. The tip end portion 114 protrudes toward the left from the left face of the base end portion 113. The diameter of the base face (right face) of the tip end portion 114 is generally the same as the outer diameter of the base end portion 113. The perimeter face of the tip end portion 114 defines a first guide surface 115 which guides engagement between the tip end portion 114 and a later-described accepting recess 181.

That is to say, the first guide surface 115 is situated at the left end of the engaging boss 93, and has an inclined surface which inclines toward the center axial line of the engaging boss 93 toward the left.

The number of the multiple retaining protrusions 94 is four, which are disposed with 90 degrees intervals therebetween in the perimeter direction of the base end portion 113 of the engaging boss 93. Each of the retaining protrusions 94 has a general plate shape in side view, protruding outward from the perimeter face of the base end portion 113 of the engaging boss 93, in the radial direction of the engaging boss 93. The right end portions of the retaining protrusions 94 are connected to the left face of the plate portion 85.

The detected portion 87 is disposed on the left face of the plate portion 85, at an outward portion in the radial direction. The detected portion 87 includes a first detection protrusion 95, a second detection protrusion 96, and a linking portion 97.

The first detection protrusion 95 is disposed in front of the engaging boss 93 with space provided therebetween. The first detection protrusion 95 has a general rod shape, extending in the left-right direction, and protrudes toward the left from the plate portion 85. The left-right direction dimensions of the first detection protrusion 95 are generally the same as the left-right direction dimensions of the engaging boss 93.

As illustrated in FIG. 4A, the first detection protrusion 95 extends in the radial direction of rotation of the detection gear 72 in side view, and the outer edge thereof in the radial direction matches the rim of the plate portion 85. The outer edge face of the first detection protrusion 95 in the radial direction is generally the same as the perimeter face of the plate portion 85.

The second detection protrusion 96 is disposed to the lower front of the engaging boss 93 with space provided therebetween, as illustrated in FIG. 3B. The second detection protrusion 96 has a general rod shape, extending in the left-right direction, and protrudes toward the left from the plate portion 85. The left-right direction dimensions of the second detection protrusion 96 are generally the same as the left-right direction dimensions of the first detection protrusion 95.

As illustrated in FIG. 4A, the second detection protrusion 96 extends in the radial direction of rotation of the detection gear 72 in side view, and the outer edge thereof in the radial direction matches the rim of the plate portion 85. The outer edge face of the second detection protrusion 96 in the radial direction is generally the same as the perimeter face of the plate portion 85.

The linking portion 97 is disposed between the first detection protrusion 95 and the second detection protrusion 96 in the peripheral direction of rotation of the detection gear 72, as illustrated in FIG. 3B. The left-right direction dimensions of the linking portion 97 are generally the same as the left-right direction dimensions of the base end portion 113 of the engaging boss 93, and are shorter than the left-right direction dimensions of the of the first detection protrusion 95.

The linking portion 97 extends following the rotational direction R of the detection gear 72 in side view, so as to link the outer portion of the first detection protrusion 95 in the radial direction with the outer portion of the second detection protrusion 96 in the radial direction, as illustrated in FIG. 4A. The outer face of the linking portion 97 in the radial direction is generally flush with the peripheral face of the plate portion 85.

The detection gear 72 is supported by the left wall 33 through the cap 40, by the shaft insertion portion 91 rotatably accepting the detection gear supporting shaft 51, as illustrated in FIG. 5. Accordingly, the detection gear 72 is capable of rotating on a center axial line A of the shaft insertion portion 91 as the center of rotation, with regard to the left wall 33, as illustrated in FIG. 4A. That is to say, the center axial line A of the detection gear supporting shaft 51 extends in the left-right direction, and serves as an example of a center axial line of the detection gear 72. The center axial line A of the shaft insertion portion 91 matches the center axial line of the engaging boss 93, so the engaging boss 93 is disposed at the center of rotation of the detection gear 72 as viewed from the left.

When projected in the left-right direction, the rear end portion of the plate portion 85 overlaps the front end portion of the second gear portion 81 of the agitator gear 71.

(2-2) Spring Member

The spring member 100 is a hollow coil form, as illustrated in FIGS. 2 and 5, and extends in the left-right direction. The spring member 100 is passed over the engaging boss 93 as illustrated in FIG. 2, and the right end of the spring member 100 is retained by the multiple retaining protrusions 94, whereby the spring member 100 is supported by the detection gear 72.

The right end of the spring member 100 is in contact with the left face of the plate portion 85 as illustrated in FIG. 5, and the left end of the spring member 100 is in contact with the right face of the left end portion of a later-described accommodating portion 107. That is to say, the spring member 100 is sandwiched between the plate portion 85 and the left end portion of the later-described accommodating portion 107, so as to constantly press the detection gear 72 to the right, i.e., toward the cap 40.

(2-3) Gear Cover

The cover member 66 covers the gear train 65 as viewed from the left, as illustrated in FIG. 2. The cover member 66 includes a first cover 101 and a second cover 102.

The first cover 101 is a rear portion of the cover member 66 and covers the rear portion of the gear train 65, more specifically the developing coupling 67, developing gear 68, and supply gear 69 from the left. The first cover 101 has a general box shape opened toward the right and front. The first cover 101 is of a size sufficient to cover the developing coupling 67, developing gear 68, and supply gear 69 all at once.

The first cover 101 has a coupling exposure opening 104. The coupling exposure opening 104 is situated at the left wall of the first cover 101. The coupling exposure opening 104 has a generally circular shape in side view, and penetrates the generally middle portion of the left wall of the first cover 101 in the left-right direction.

The first cover 101 exposes the linking recess portion 75 of the developing coupling 67 through the coupling exposure opening 104, and is screwed to a rear portion of the left wall 33 so as to cover the coupling portion 74 of the developing coupling 67, the developing gear 68, and the supply gear 69, all at once.

The second cover 102 is a front portion of the cover member 66 and covers the front portion of the gear train 65, more specifically the idle gear 70, agitator gear 71, and detection gear 72 from the left. The second cover 102 has a general box shape opened toward the right and rear. The second cover 102 is of a size sufficient to cover the idle gear 70, agitator gear 71, and detection gear 72 all at once.

The second cover 102 has a through opening 105, a peripheral wall 106, an accommodation portion 107, and a linking portion 108, as illustrated in FIGS. 2 and 5.

The through opening 105 is situated in the left wall of the second cover 102, as illustrated in FIG. 5. The through opening 105 has a generally circular shape in side view, and penetrates the front portion of the left wall of the second cover 102 in the left-right direction. The inner diameter of the through opening 105 is larger than the outer diameter of the plate portion 85.

The peripheral wall 106 has a general cylinder shape extending in the left-right direction, protruding to the left from the rim of the through opening 105.

The accommodation portion 107 has a general cylinder shape extending in the left-right direction, with the left end portion of the accommodation portion 107 being closed off. The accommodation portion 107 is disposed within the peripheral wall 106, of which the center axial line matches that of the accommodation portion 107.

The accommodation portion 107 has an opening 110. The opening 110 is situated to the left end portion of the accommodation portion 107. The opening 110 has a generally circular shape in side view, and penetrates the middle portion in radial direction of the left end portion of the accommodation portion 107 in the left-right direction, as illustrated in FIG. 2. The inner diameter of the opening 110 is larger than the outer diameter of the base end portion 113 of the engaging boss 93.

The linking portion 108 is disposed beneath the accommodation portion 107 in the peripheral wall 106. The linking portion 108 links the outer perimeter face of the accommodation portion 107 and the inner perimeter face of the peripheral wall 106, in the radial direction of the peripheral wall 106.

The inner perimeter face of the peripheral wall 106, the outer perimeter face of the accommodation portion 107, and the front and back faces of the linking portion 108, define a detected portion insertion opening 109. The detected portion insertion opening 109 has a generally C-shaped form in side view which is opened downwards, and penetrates the second cover 102 in the left-right direction.

The second cover 102 accepts the left end of the spring member 100 at the accommodation portion 107 thereof, and is screwed to the rear portion of the left wall 33 so as to cover the idle gear 70, agitator gear 71, and detection gear 72 all at once.

Accordingly, the detected portion 87 of the detection gear 72 is disposed within the peripheral wall 106, and the left end faces of the first detection protrusion 95 and second detection protrusion 96 are situated slightly to the right of the left end face of the peripheral wall 106.

3. Details of Main Unit Casing

The main unit casing 2 includes a main unit coupling 200, an engaging unit 179, and a detection mechanism 190 which is an example of a detecting portion, as illustrated in FIGS. 2 and 5.

As illustrated in FIG. 2, the main unit coupling 200 is disposed with space at the left side as to the linking recess portion 75 of the developing coupling 67, in a state where the developing cartridge 15 is mounted to the main unit casing 2. The main unit coupling 200 has a general columnar shape extending in the left-right direction, and the right end portion thereof is configured so as to be insertable to the linking recess portion 75.

The main unit coupling 200 is configured to move in the left-right direction in coordination with opening/closing operations of the front cover 21, by a known coordination mechanism. The main unit coupling 200 is also configured so that driving force from a drive source such as an unshown motor or the like, provided to the main unit casing 2, is transmitted. Upon the driving force being supplied, the main unit coupling 200 rotates in the clockwise direction in left view.

The engaging unit 179 is disposed with space at the left as to the peripheral wall 106 Bf the second cover 102, in a state where the developing cartridge 15 is mounted to the main unit casing 2, as illustrated in FIG. 5.

Figure 3C:
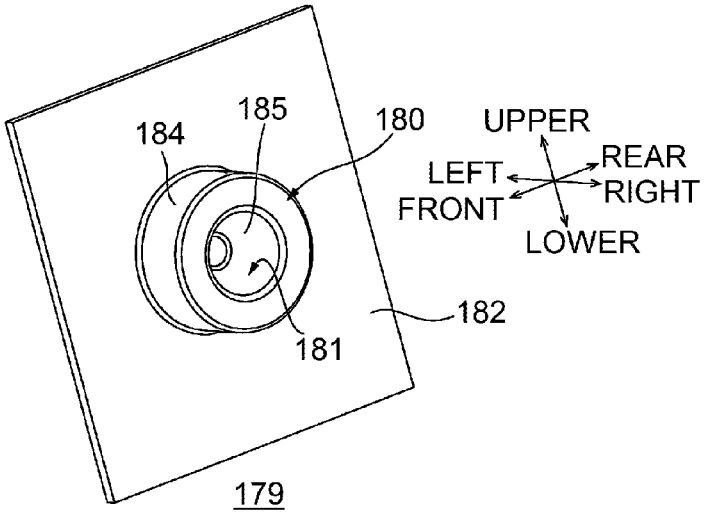
FIG. 3C is a perspective view of an engaging unit which the printer illustrated in FIG. 1 has, from the right side.

The engaging unit 179 is supported by the main unit casing 2, and includes a plate 182 and a second engaging portion 180, as illustrated in FIG. 3C.

The plate 182 has a plate shape, generally rectangular in side view, with a hole 183 formed therein as illustrated in FIG. 5. The hole 183 is formed at the generally middle portion of the plate 182 in side view. The hole 183 is generally circular in side view, and penetrates the plate 182 in the left-right direction.

The second engaging portion 180 is disposed on the right face of the plate 182, and includes a tubular portion 184 and the accepting recess 181.

The tubular portion 184 has a general cylinder shape extending in the left-right direction, protruding to the right from the rim of the hole 183. The right end of the tubular portion 184 is closed off.

The accepting recess 181 is situated at the general middle in side view of the right end of the tubular portion 184. The accepting recess 181 corresponds to the tip end portion 114 of the engaging boss 93, and is recessed so as to be capable of accepting the tip end portion 114.

Specifically, the accepting recess 181 has a conical trapezoid shape which grows narrower toward the left, and recessed from the right end of the tubular portion 184 toward the left. The inner perimeter face of the accepting recess 181 defines a second guide surface 185 to guide engagement of the tip end portion 114 and accepting recess 181.

The detection mechanism 190 is configured so as to detect the first detection protrusion 95 and second detection protrusion 96, as illustrated in FIG. 10A. The detection mechanism 190 is disposed above the second engaging portion 180 of the engaging unit 179, as illustrated in FIG. 5.

The detection mechanism 190 includes an actuator 191 and an optical sensor 194, as illustrated in FIG. 4A.

The actuator 191 includes a rocking shaft 193, an abutting lever 192, and a light shielding lever 195.

The rocking shaft 193 has a general columnar shape extending in the left-right direction, and is rotatably supported by the main unit casing 2.

The abutting lever 192 is disposed beneath the rocking shaft 193, and has a general fan shape in side view, of which the center angle is approximately 90 degrees. The center angle portion of the abutting lever 192 is connected to the rocking shaft 193.

The light shielding lever 195 is disposed on the opposite side of the rocking shaft 193 as to the abutting lever 192, that is to say on the upper front of the rocking shaft 193. The light shielding lever 195 has a generally rectangular shape in side view, extending in a direction connecting the upper front and lower rear. The lower end portion of the light shielding lever 195 is connected to the rocking shaft 193.

The actuator 191 is capable of rocking between a non-detection position extending in the direction of the front edge of the abutting lever 192 connecting the upper roar and lower front, and a detection position where the front edge of the abutting lever 192 extends in the vertical direction as illustrated in FIG. 10A. The actuator 191 is normally disposed in a non-detecting position by spring force of an unshown spring.

The optical sensor 194 has a known light-emitting element and light-receiving element, with the light-emitting element and light-receiving element disposed so as to face each over across a gap. When the actuator 191 is in a non-detection position, the optical sensor 194 shields the optical path of light from the light-emitting element to the light-receiving element, and when the actuator 191 is in a detection position, the optical sensor 194 is retracted from the optical path of light from the light-emitting element to the light-receiving element.

When the actuator 191 is in a non-detection position and the light shielding lever 195 is shielding the optical path of light from the light-emitting element to the light-receiving element, the optical sensor 194 outputs an off signal. When the actuator 191 is in a detection position and the light shielding lever 195 has retracted from the optical path of light from the light-emitting element to the light-receiving element, the optical sensor 194 outputs an on signal. A microprocessor is electrically connected to the optical sensor 194, though omitted from illustration.

4. Mounting/Detaching Operations of Developing Cartridge to/from Main Unit Casing, and New Developing Cartridge Detection

(4-1) Mounting Operations of Developing Cartridge to Main Unit Casing

A new developing cartridge 15 before being used for the first time has the detection gear 72 thereof situated at the initial position, as illustrated in FIGS. 4A through 5. That is to say, the initial position is the position before rotation operation of the detection gear 72 starts.

In the state of the initial position of the detection gear 72, the downstream end portion of the detection gear portion 88 in the rotational direction R does not mesh with the first gear portion 80 of the agitator gear 71, but rather is separated therefrom and situated to the upper front, as illustrated in FIG. 4A. The second abutting portion 89 is situated so as to overlap the second gear portion 81 in left view, and is situated with space at the left as to the second gear portion 81, as illustrated in FIG. 4B.

In the state of the initial position, the detection gear 72 is situated to the farthest right relatively by force of the spring member 100, and is situated near the left wall 33, as illustrated in FIG. 5. Accordingly, the right end of the shaft insertion portion 91 of the detection gear 72, and the sliding portion 118 of the guide rib 90, both come into contact with the left face of the closure portion 45 of the cap 40.

The right portion of the guide rib 90 is situated between the first stopper 53 and the lower edge portion of guide portion 52, as illustrated in FIG. 4B. That is to say, the sliding portion 118 of the guide rib 90 is situated upstream of the first inclined surface 55 of the guide portion 52 in the rotational direction R.

In the state of the initial position of the detection gear 72, the engaging boss 93 is situated at the farthest right relatively, and is at a first position near the left wall 33. Note that the distance in the left-right direction between the left end portion of the engaging boss 93 in the first position and the left wall 33 is an initial distance L1.

The tip portion 114 of the engaging boss 93 is situated within the accommodation portion 107, and the base end portion 113 of the engaging boss 93 is positioned within the right side portion of the peripheral wall 106, as illustrated in FIG. 5. The tip end portion 114 of the engaging boss 93 faces the opening 110 in the left-right direction.

The detected portion 87 is disposed to the lower front of the first engaging portion 86 as illustrated in FIG. 2, so as to be situated upstream from the detected portion insertion opening 109 in the rotational direction R from the left side.

When mounting such a new developing cartridge 15 to the main unit casing 2, a worker opens the front cover 21 as illustrated in FIG. 1, and inserts the developing cartridge 15 from the front of the main unit casing 2 through the opening portion 20, and then closes the front cover 21.

This completes mounting of the developing cartridge 15 to the main unit casing 2.

At this time, the second engaging portion 180 of the engaging unit 179, and the accommodation portion 107 of the second cover 102, face each other across a space in the left-right direction, and the accepting recess 181 of the second engaging portion 180 and the opening 110 of the accommodation portion 107 face each other in the left-right direction. That is to say, in a state where the developing cartridge 15 has been mounted to the main unit casing 2, the engaging boss 93 at the first position and the second engaging portion 180 are separated.

(4-2) New Developing Cartridge Detecting Operations

Next, detection operations of the developing cartridge 15 will be described with reference to FIGS. 4A through 14. Note that the cover member 66 and spring member 100 have been omitted from illustration in FIGS. 4A, 4B, 6A, 6B, 8, 10A, 10B, and 12A through 13, to facilitate description.

Upon the front cover 21 being closed, the main unit coupling 200 of the main unit casing 2 is made to enter the linking recess portion 75 of the coupling portion 74 incapable of relative rotation, by an unshown known coordination mechanism, and thus engages the protruding structures 76, as illustrated in FIG. 2.

Thereafter, warm-up operations of the printer 1 are initiated under control of an unshown control unit provided to the main unit casing 2.

In the warm-up operations, the main unit coupling 200 inputs driving force to the coupling portion 74 of the developing coupling 67. The developing coupling 67 then rotates clockwise in left view. At this time, the developing coupling 67 transmits driving force to each of the gears meshing with the coupling gear portion 73, which is to say the developing gear 68, supply gear 69, and large-diameter gear 77 of the idle gear 70, as illustrated in FIG. 13.

Upon driving force being transmitted to each of the developing gear 68 and supply gear 69, the developing roller 4 rotates in the counterclockwise direction in left view under the driving force transmitted to the developing gear 68, and the supply roller 5 rotates in the counterclockwise direction in left view under the driving force transmitted to the supply gear 69, as illustrated in FIG. 1.

Upon driving force being transmitted to the large-diameter gear 77, the idle gear 70 rotates in the counterclockwise direction in left view, and transmits driving force to the second gear portion 81 of the agitator gear 71 meshing the small-diameter gear 79, as illustrated in FIG. 4A.

Upon driving force being transmitted to the second gear portion 81, the agitator gear 71 rotates in the clockwise direction in left view. This causes the first abutting portion 82 to move along with the rotation of the agitator gear 71 so as to pass through the notch 99 of the detection gear portion 88 of the detection gear 72, through omitted from illustration, and come into contact with the upstream end of the second abutting portion 89 of the detection gear 72 in the rotational direction R. Accordingly, the first abutting portion 82 presses downwards the upstream end of the second abutting portion 89 in the rotational direction R.

Figure 6A:
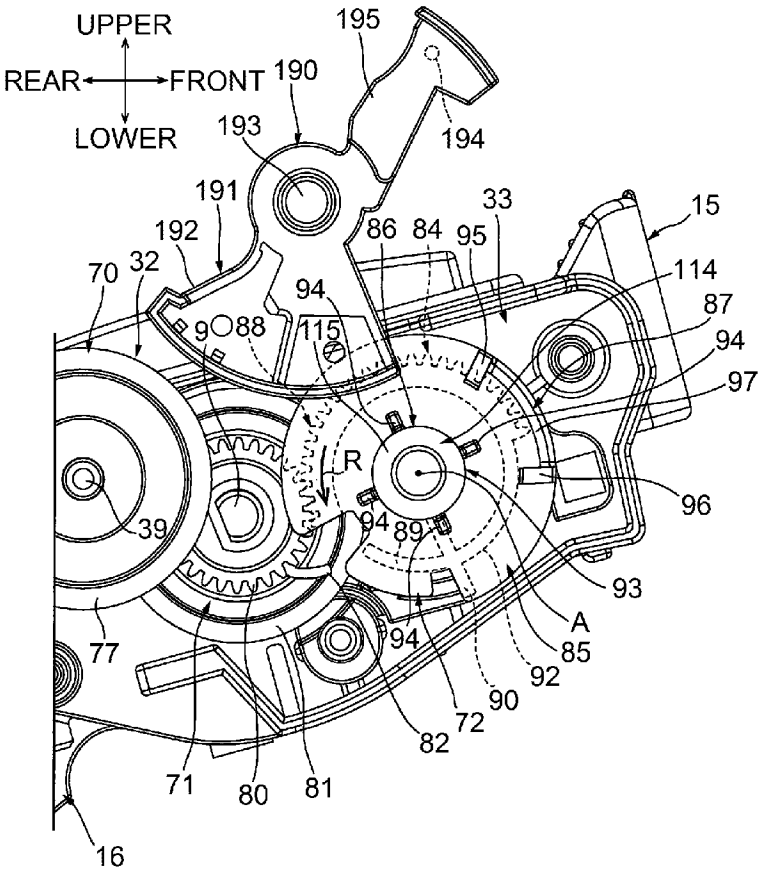
FIG. 6A is an explanatory diagram for describing the new-product detection operation by the detection unit as a continuation from FIG. 4A, illustrating a state in which the detection gear is in a state of moving from the initial position to an advanced position, as viewed from the left side.

Thereupon, the detection gear 72 rotates from the initial position in the rotational direction R, due to the pressing by the first abutting portion 82. Upon the detection gear 72 rotating, the downstream end of the detection gear portion 88 in the rotational direction R meshes with the front portion of the first gear portion 80, as illustrated in FIG. 6A. Accordingly, driving force is transmitted from the agitator gear 71 to the detection gear 72, and the detection gear 72 rotates in the rotational direction R.

The sliding portion 118 of the guide rib of the detection gear 72 then moves in the rotational direction R along with the rotation of the detection gear 72 as illustrated in FIG. 6B, so as to reach above the first inclined surface 55 of the guide portion 52.

Figure 7:
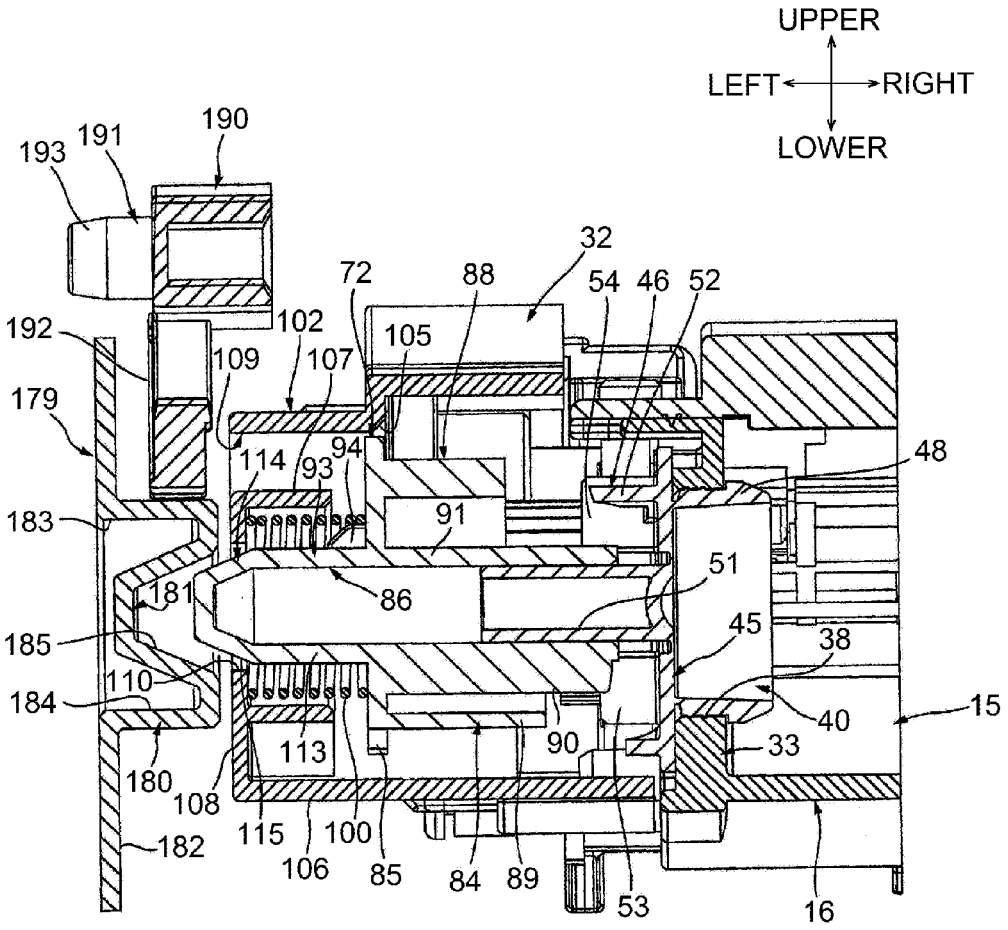
FIG. 7 is a cross-sectional view of the detection unit and engaging unit illustrated in FIG. 6A, taken in a radial direction of a boss.

This causes the detection gear 72 to gradually move to the left along the detection gear supporting shaft 51, against the biasing force of the spring member 100. The tip end portion 114 of the engaging boss 93 then passes through the opening 110 so as to protrude further left than the left face of the accommodation portion 107, as illustrated in FIG. 7.

Figure 8:
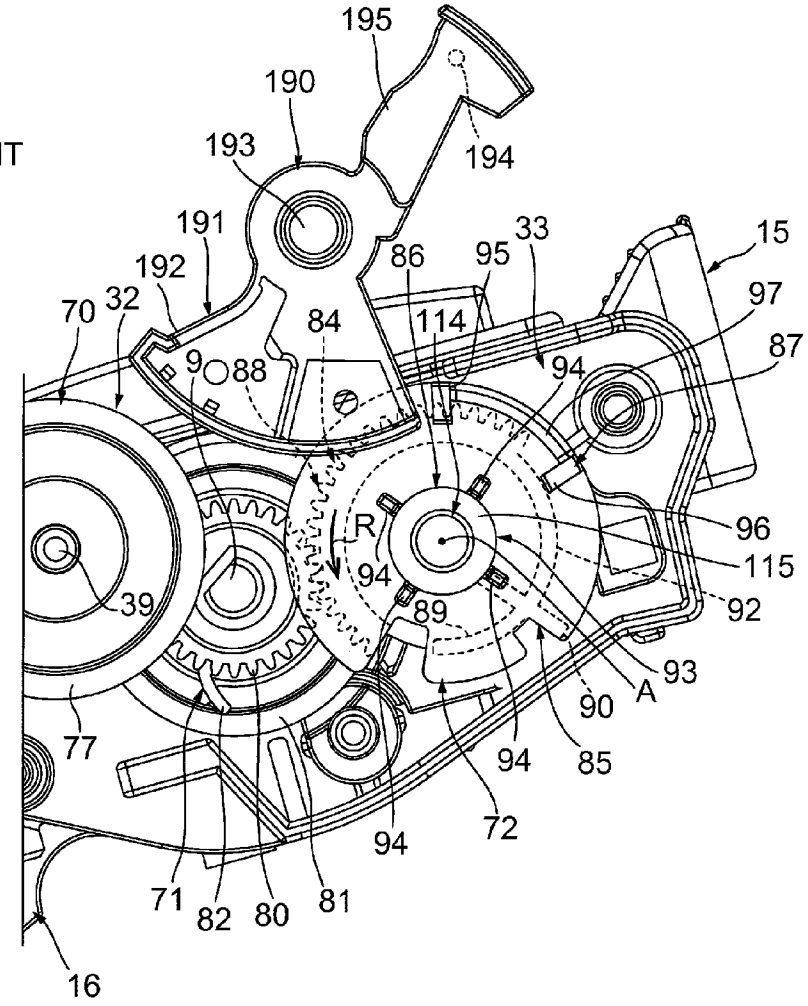
FIG. 8 is an explanatory diagram for describing the new-product detection operation by the detection unit as a continuation from FIG. 6A, illustrating a state in which the detection gear is in the advanced position, as viewed from the left side.

Next, upon the agitator gear 71 further rotating, the detection gear 72 also further rotates in the rotational direction R as illustrated in FIG. 8.

Figure 10B:
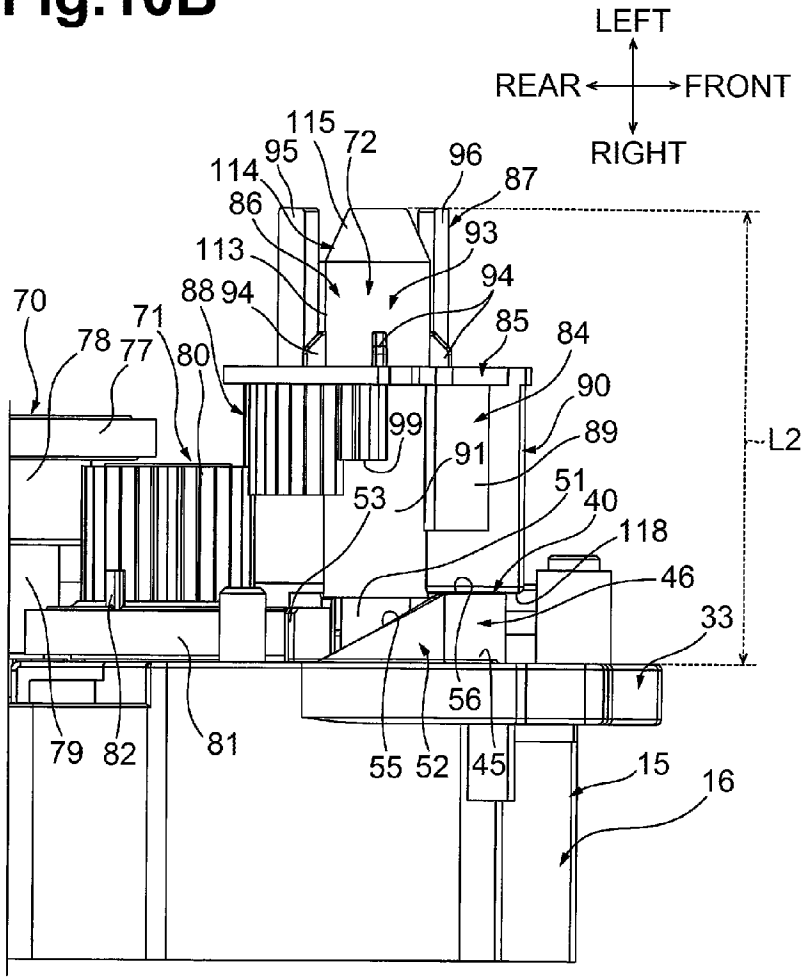
FIG. 10B is a bottom view of the detection unit illustrated in FIG. 10A.
Figure 10A:
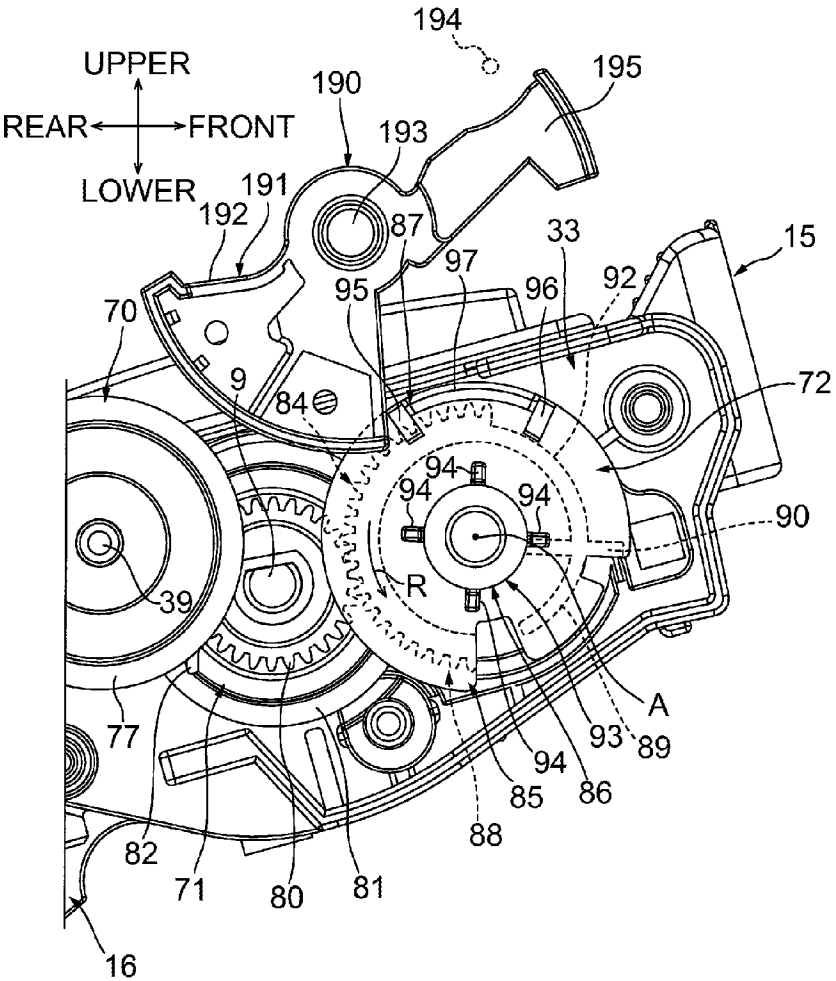
FIG. 10A is an explanatory diagram for describing the new-product detection operation by the detection unit as a continuation from FIG. 8, illustrating a state in which a first detection protrusion has abutted against the actuator, as viewed from the left side.

As the detection gear 72 rotates, the sliding portion 118 of the guide rib 90 moves in the rotational direction R while sliding over the first inclined surface 55, and moves from the first inclined surface 55 to the first parallel face 56, as illustrated in FIG. 10B.

Accordingly, the detection gear 72 moves further to the left against the biasing force of the spring member 100 by the rotations of itself. The detection gear 72 is thus situated at the advanced position which is farthest from the left wall 33.

In the state where the detection gear 72 is at the advanced position, the engaging boss 93 is situated farthest to the left relatively, and is at a second position most distanced from the left wall 33 to the left. The left-right distance between the left end portion of the engaging boss 93 in the second position and the left wall 33 is an advanced distance L2. The advanced distance L2 is greater than the initial distance L1. That is to say, the engaging boss 93 at the second position is distanced in the left direction from the left wall 33 more than the engaging boss 93 in the first position, the engaging boss 93 having moved to the first position and second position along with rotation of the detection gear 72.

Figure 9:
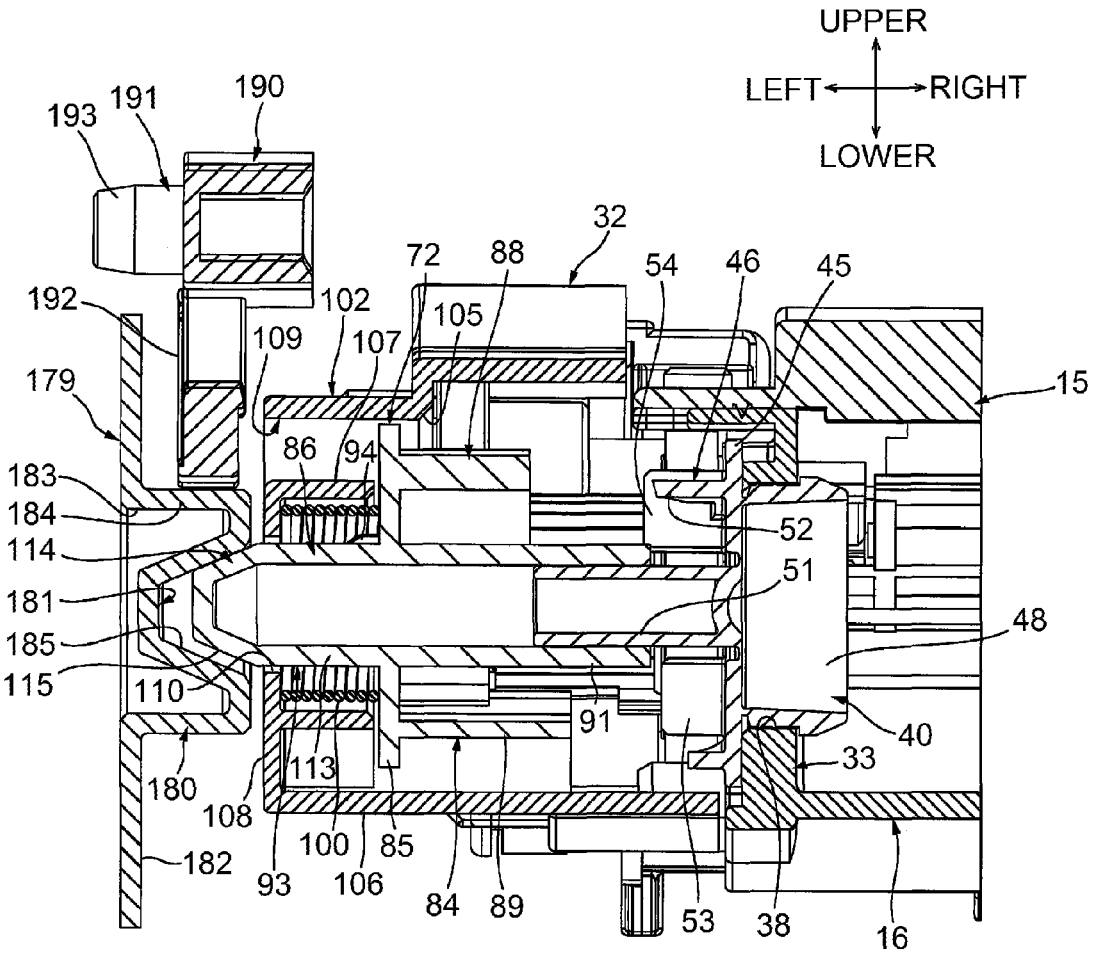
FIG. 9 is a cross-sectional view of the detection unit and engaging unit illustrated in FIG. 8, taken in a radial direction of a boss.

At this time, the tip end portion 114 of the engaging boss 93 further advances toward the left, as illustrated in FIG. 9. The first guide surface 115 of the tip end portion 114 slides over the second guide surface 185 of the accepting recess 181. Accordingly, the first guide surface 115 and second guide surface 185 each guide the engagement of the tip end portion 114 and the accepting recess 181.

Upon the engaging boss 93 reaching the second position, the tip end portion 114 of the engaging boss 93 engages the accepting recess 181. The engaging boss 93 is also positioned as to the accepting recess 181, by the planar contact of the first guide surface 115 and second guide surface 185. That is to say, the engaging boss 93 is positioned as to the accepting recess 181 before the first detection protrusion 95 is detected by the detection mechanism 190.

At this time, the left end of each of the first detection protrusion 95 and second detection protrusion 96 protrude further left than the left end face of the peripheral wall 106 through the detected portion insertion opening 109 of the second cover 102, through this is omitted from illustration. The left end of the first detection protrusion 95 is situated with space in front as to the abutting lever 192 of the actuator 191 which is in the non-detection position, as illustrated in FIG. 8. Note that the linking portion 97 is situated to the right side of the left face of the peripheral wall 106, within the peripheral wall 106.

The detection gear 72 at the advanced position continues to rotate in the rotational direction R, while maintaining the state of the engaging boss 93 having been positioned as to the accepting recess 181. The sliding portion 118 of the guide rib 90 moves in the rotational direction R while sliding over the first parallel face 56, and the first detection protrusion 95 moves in the rotational direction R as illustrated in FIG. 10A.

The left end of the first detection protrusion 95 comes into contact with the lower end portion of the abutting lever 192 from the front. Accordingly, the first detection protrusion 95 presses the lower end of the abutting lever 192 backwards. The actuator 191 rocks clockwise in left view from the non-detection position, and moves to the detection position. The light shielding lever 195 moves clockwise in left view at this time, so as to be retracted from the optical path of light from the light-emitting element to the light-receiving element of the optical sensor 194. Accordingly, the optical sensor 194 detects rocking of the actuator 191 form the non-detection position to the detection position, outputs an on signal, and the detection mechanism 190 detects the first detection protrusion 95. That is to say, the detection mechanism 190 detects the first detection protrusion 95 in a state in which the tip end portion 114 of the engaging boss 93 has engaged the accepting recess 181 of the second engaging portion 180.

Upon the detection gear 72 rotating further, the first detection protrusion 95 moves away from the abutting lever 192, and the linking portion 97 is situated to the right of the abutting lever 192 with space therebetween. The actuator 191 then rotates form the detection position to the non-detection position.

Consequently, the light shielding lever 195 of the actuator 191 shields the optical path of light from the light-emitting element to the light-receiving element of the optical sensor 194, and the optical sensor 194 detects rocking of the actuator 191 from the detection position to the non-detection position. The optical sensor 194 then switches the on signal to an off signal.

Next, upon the detection gear 72 rotating even further, the left end of the second detection protrusion 96 comes into contact with the lower end portion of the abutting lever 192 from the front. Accordingly, the second detection protrusion 96 presses the lower end of the abutting lever 192 backwards. The actuator 191 rocks clockwise in left view from the non-detection position again, and moves to the detection position. The light shielding lever 195 moves clockwise in left view at this time, so as to be retracted from the optical path of light from the light-emitting element to the light-receiving element of the optical sensor 194, and the optical sensor 194 detects rocking of the actuator 191 from the non-detection position to the detection position. Thus, the optical sensor 194 outputs an on signal, and the detection mechanism 190 detects the second detection protrusion 96. That is to say, the detection mechanism 190 detects the second detection protrusion 96 in a state in which the tip end portion 114 of the engaging boss 93 has engaged the accepting recess 181 of the second engaging portion 180.

At this time, the first detection protrusion 95 and linking portion 97 pass to the left of the front side of the first gear portion 80.

Next, upon the detection gear 72 rotating even further, the second detection protrusion 96 moves away from the abutting lever 192 as illustrated in FIG. 12A. The actuator 191 then rotates from the detection position to the non-detection position again. Accordingly, the optical sensor 194 detects rocking of the actuator 191 from the detection position to the non-detection position in the same way as described above, and then switches the on signal to an off signal.

Next, upon the detection gear 72 rotating further, the sliding portion 118 of the guide rib 90 reaches the second inclined surface 57 from the first parallel face 56, as illustrated in FIG. 13.

The sliding portion 118 of the guide rib 90 of the detection mechanism 190 then gradually moves to the right under the biasing force of the spring member 100 while sliding over the second inclined surface 57, as the rotation of the detection gear 72 progresses. Accordingly, the engaging boss 93 gradually moves from the second position to the right, as the rotation of the detection gear 72 progresses.

Upon the detection gear 72 rotating even further, the sliding portion 118 of the guide rib 90 reaches the continuous portion of the second inclined surface 57 and notched face 58. Thereupon, the detection gear 72 moves to the right all at once under the biasing force of the spring member 100, until the sliding portion 118 of the guide rib 90 and the second parallel face 59 come into contact.

Figure 14:
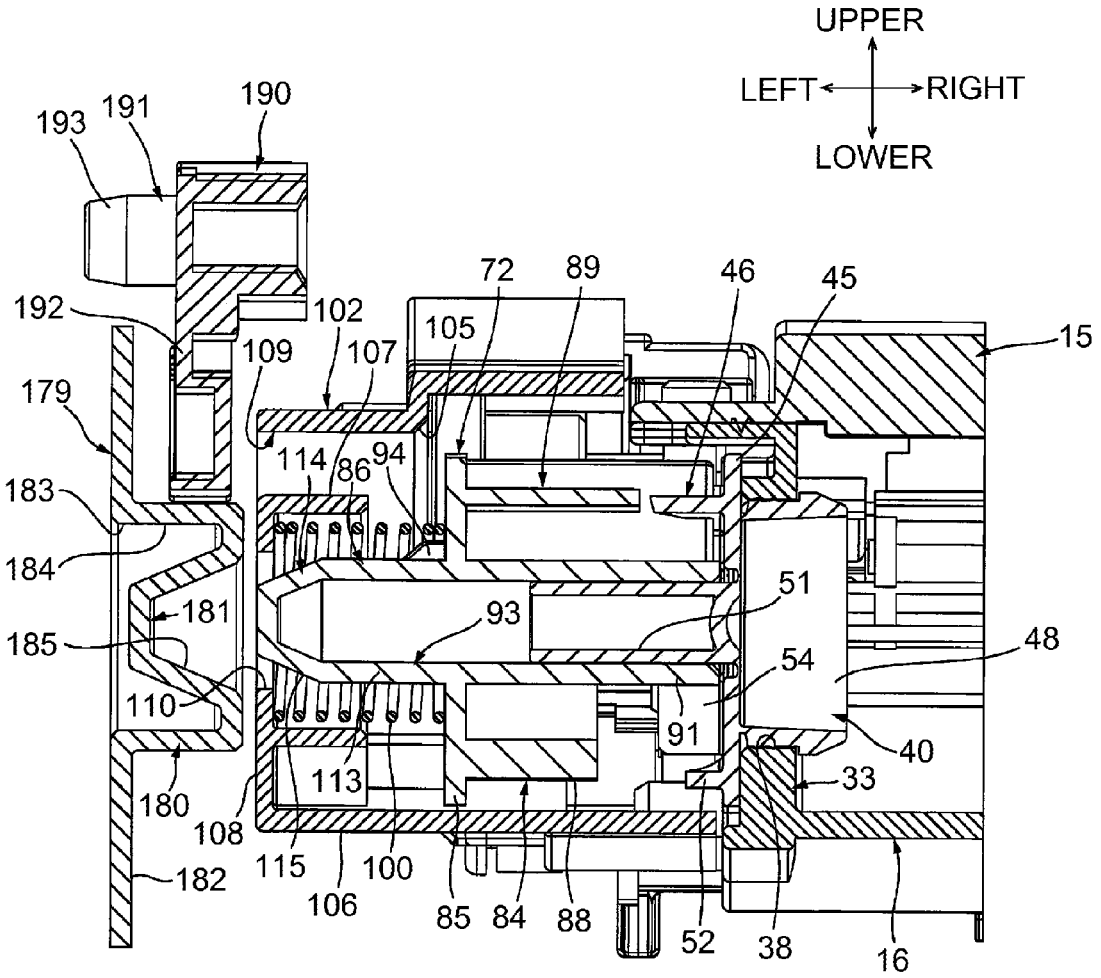
FIG. 14 is a cross-sectional view of the detection unit and engaging unit illustrated in FIG. 12A, taken in a radial direction of a boss.

The engaging boss 93 then moves to the right as illustrated in FIG. 14, and the tip end portion 114 of the engaging boss 93 is detached from the accepting recess 181 of the second engaging portion 180. The engaging boss 93 is then accommodated in the peripheral wall 106, and the tip end portion 114 is accommodated in the accommodation portion 107.

The first detection protrusion 95 and second detection protrusion 96 also move to the right, so that the left edge faces of the first detection protrusion 95 and second detection protrusion 96 are generally flush with the left end face of the peripheral wall 106, though this is omitted from illustration.

At this time, the meshing of the detection gear portion 88 of the detection gear 72 and the first gear portion 80 of the agitator gear 71 is disengaged, and rotation of the detection gear 72 stops, as illustrated in FIG. 12A. Accordingly, the detection gear 72 is at the destination position at the time of ending the rotation operations.

Note that the distance between the left end portion of the engaging boss 93 of the detection gear 72 at the destination position, and the left wall 33, is a destination distance L3. This destination distance L3 is smaller than the advanced distance L2 but larger than the initial distance L1.

Figure 12B:
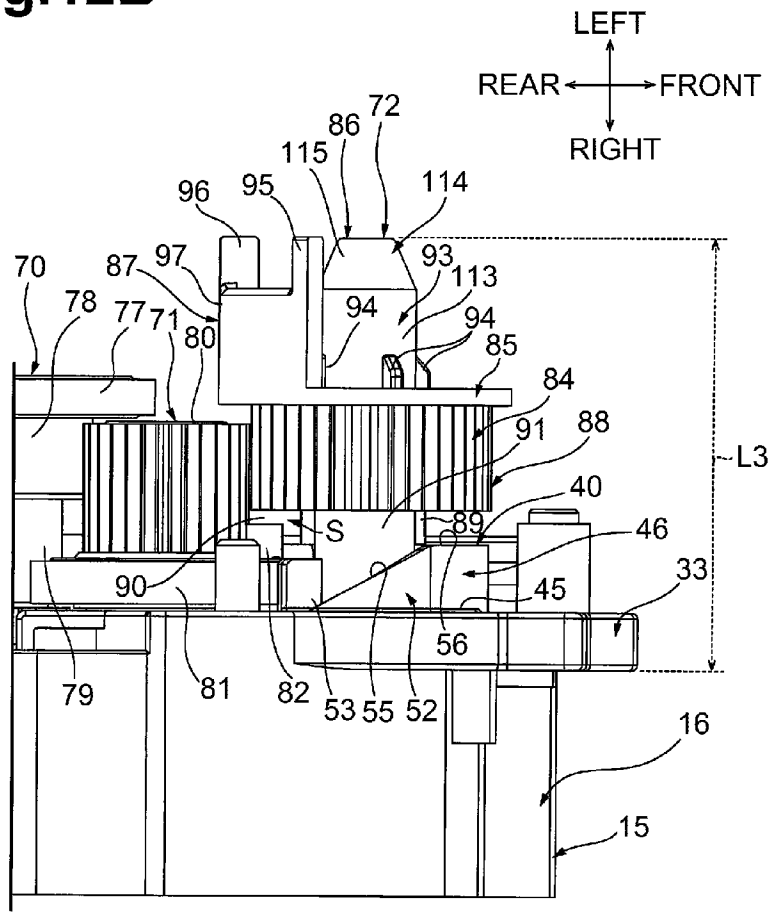
FIG. 12B is a bottom view of the detection unit illustrated in FIG. 12A.
Figure 12A:
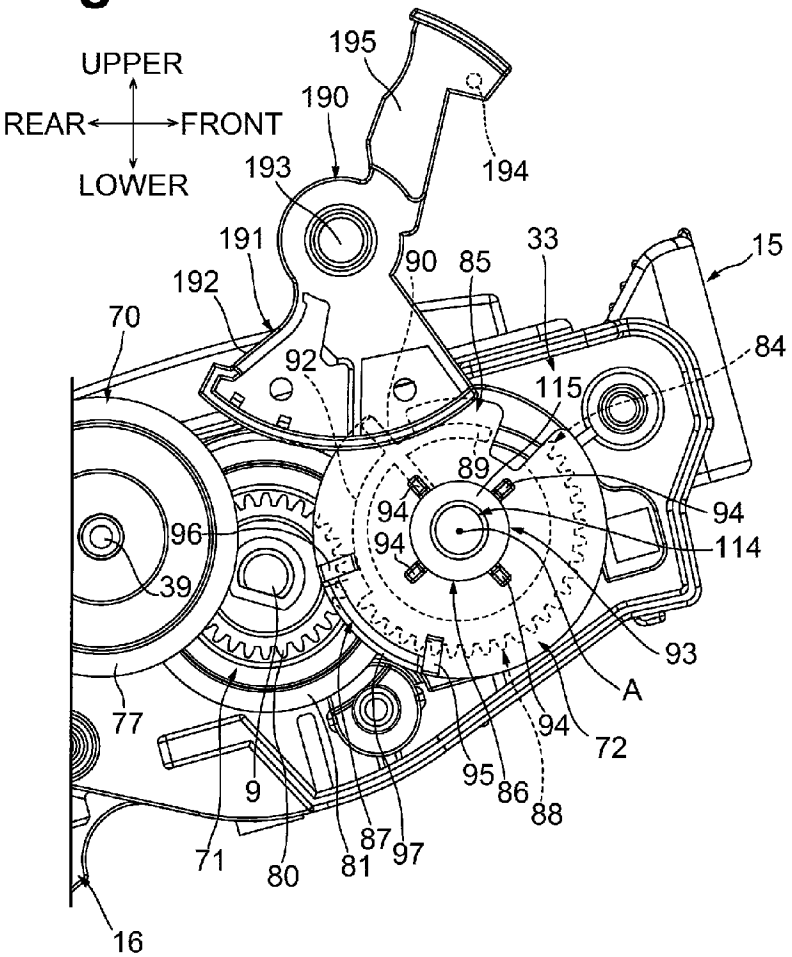
FIG. 12A is an explanatory diagram for describing the new-product detection operation by the detection unit as a continuation from FIG. 10A, illustrating a state in which the detection gear is at a destination position.

Also, when the agitator gear 71 rotates in the state where the detection gear 72 is at the destination position, the first abutting portion 82 passes through a gap S in the left-right direction between the detection gear portion 88 and the second gear portion 81, as illustrated in FIG. 12B. The guide rib 90 of the detection gear 72 is situated to the upper front of the agitator gear 71 as illustrated in FIG. 12A, and thus is separated from the path of movement of the first abutting portion 82 due to rotation of the agitator gear 71.

Also, in the state where the detection gear 72 is at the destination position, the right portion of the guide rib 90 is situated between the second stopper 54 and the notched face 58 in the rotational direction R, as illustrated in FIG. 13. That is to say, the second stopper 54 is adjacent downstream in the rotational direction R to the guide rib 90 of the detection gear 72 at the terminal position, and restricts rotation of the detection gear 72 in the downstream direction in the rotational direction R. The notched face 58 of the guide portion 52 is adjacent upstream in the rotational direction R to the guide rib 90 of the detection gear 72 at the destination position, and restricts rotation of the detection gear 72 in the upstream direction in the rotational direction R. Thus, the detection gear 72 is held at the destination position, and remains still unrelated to rotation of the agitator gear 71.

Thus, upon a new developing cartridge 15 being mounted to the main unit casing 2 for the first time, the optical sensor 194 outputs two on signals. Accordingly, the unshown microprocessor determines that the developing cartridge 15 is new if two on signals of the optical sensor 194 are detected after having mounted a developing cartridge 15 to the main unit casing 2.

On the other hand, in a case of a used developing cartridge 15, which is a developing cartridge 15 that has already been mounted to the main unit casing 2 once, being mounted to the main unit casing 2, the detection gear 72 at the destination position remains still regardless of any rotations of the agitator gear 71.

Accordingly, in a case where the optical sensor 194 does not output an on signal within a predetermined amount of time after the developing cartridge 15 is mounted to the main unit casing 2, the developing cartridge 15 is determined by the unshown microprocessor to be a used article.

(4-3) Detaching Operations of Developing Cartridge from Main Unit Casing

In a used developing cartridge 15, the detection gear 72 is situated at the destination position as described above. The left end faces of the first detection protrusion 95 and second detection protrusion 96 are situated within the peripheral wall 106 so as to be generally flush with the left end face of the peripheral wall 106 of the second cover 102.

Detaching such a used developing cartridge 15 from the main unit casing 2 is performed by the worker performing procedures in the reverse as described above.

In detail, the worker opens the front cover 21 as illustrated in FIG. 1, and draws the developing cartridge 15 out to the front. This ends detaching of the developing cartridge 15 from the main unit casing 2.

Figure 11:
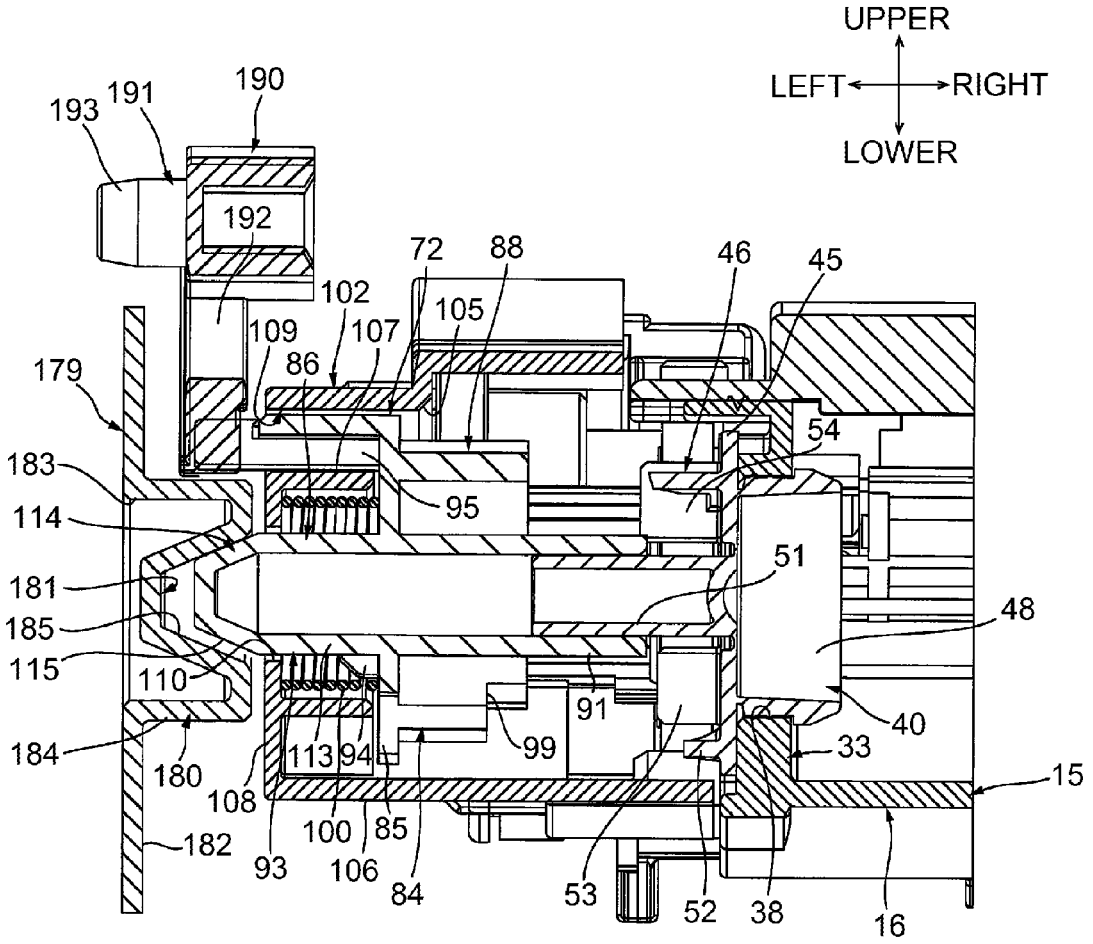
FIG. 11 is a cross-sectional view of the detection unit and engaging unit illustrated in FIG. 10A, taken in a radial direction of a boss.

5. Advantages (1) As illustrated in FIGS. 10A and 11, at least when the detection mechanism 190 detects the detected portion 87, the engaging boss 93 of the detection gear 72 and the accepting recess 181 of the engaging unit 179 are engaged by rotation of the detection gear 72. Accordingly, relative positioning precision of the detection gear 72 as to the main unit casing 2 can be improved, and consequently, relative positional precision between the main unit casing 2 and the guide rib 90 can be improved.

As a result, the detection mechanism 190 can detect the detected portion 87 in a sure manner, and detection precision of the detected portion 87 by the detection mechanism 190 can be improved.

(2) Also, the engaging boss 93 of the first engaging portion 86 moves to a first position of being situated near the left wall 33 in the left-right direction, and a second position of being separated to the left from the left wall 33 in the left-right direction, in conjunction with rotation of the detection gear 72, as illustrated in FIGS. 4B and 10B.

Upon the detection mechanism 190 detecting the detected portion 87, the engaging boss 93 is situated in the second position, and the tip end portion 114 of the engaging boss 93 is engaged with the accepting recess 181 of the second engaging portion 180, as illustrated in FIGS. 10A and 11. That is to say, the engaging boss 93 moves to the left along with rotations of the detection gear 72, and is engaged with the accepting recess 181.

Accordingly, when the detection mechanism 190 detects the detected portion 87, secure engagement between the engaging boss 93 of the first engaging portion 86 and the accepting recess 181 of the second engaging portion 180 can be ensured. Thus, relative positional precision of the detected portion 87 of the detection gear 72 and the detection mechanism 190 of the main unit casing 2 can be improved in a sure manner.

(3) Also, the axial lines of the first engaging portion 86 and the engaging boss 93 match the center axial line A which is the center of rotation of the detection gear 72, as illustrated in FIG. 4A. That is to say, the engaging boss 93 is situated on the center of rotation of the detection gear 72 as viewed from the left.

Accordingly, decentering of the engaging boss 93 when the detection gear 72 rotates can be prevented. Consequently, relative positional precision of the first engaging portion 86 and second engaging portion 180 can be improved when engaging the engaging boss 93 of the first engaging portion 86 and the accepting recess 181 of the second engaging portion 180 by rotating the detection gear 72, so the engaging boss 93 and the accepting recess 181 can be engaged in an even more sure manner.

(4) Also, the tip end portion 114 of the engaging boss 93 has a first guide surface 115 as illustrated in FIG. 3B. Accordingly, when the tip end portion 114 of the engaging boss 93 and the accepting recess 181 are engaged, the first guide surface 115 guides the engagement of the tip end portion 114 of the engaging boss 93 and the accepting recess 181, as illustrated in FIG. 9. As a result, smooth engagement of the tip end portion 114 of the engaging boss 93 and the accepting recess 181 can be ensured.

(5) Also, the accepting recess 181 has a second guide surface 185 as illustrated in FIG. 3C. Accordingly, when the tip end portion 114 of the engaging boss 93 and the accepting recess 181 are engaged, the first guide surface 115 and second guide surface 185 guide the engagement of the tip end portion 114 of the engaging boss 93 and the accepting recess 181, in a sure manner, as illustrated in FIG. 9.

Also, the engaging boss 93 is positioned as to the second engaging portion 180 by the first guide surface 115 and second guide surface 185 coming into contact. Accordingly, the precision of the relative position between the engaging boss 93 and the accepting recess 181 can be improved.

As a result, positioning precision of the engaging boss 93 and the accepting recess 181 can be improved while enabling even smoother engagement of the tip end portion 114 of the engaging boss 93 and the accepting recess 181.

Also, the first guide surface 115 and the second guide surface 185 serve both as parts to guide engaging of the tip end portion 114 of the engaging boss 93 and the accepting recess 181, and parts for positioning the engaging boss 93 to the second engaging portion 180, so the number of parts can be reduced.

Also, the engaging boss 93 is positioned as to the second engaging portion 180 by the first guide surface 115 and second guide surface 185 coming into contact, so once the engaging boss 93 can be moved to where the first guide surface 115 and the second guide surface 185 come into contact, these can guide the engagement of the engaging boss 93 and the accepting recess 181, and also the engaging boss 93 can be positioned as to the second engaging portion 180.

That is to say, engagement of the engaging boss 93 and accepting recess 181 can be guided, and the engaging boss 93 be positioned to the second engaging portion 180, even if the movement amount of the engaging boss 93, i.e., the movement amount of the detection gear 72 is reduced.

As a result, reliable movement of the detection gear 72 can be ensured, and reduction of the size of the printer 1 in the left-right direction can be realized. Further, even smoother engagement of the engaging boss 93 and the accepting recess 181 can be ensured, and relative positional precision of the engaging boss 93 and second engaging portion 180 can be improved.

(6) Also, the first engaging portion 86 has the engaging boss 93 extending in the left-right direction, as illustrated in FIG. 3B. Accordingly, the tip end portion 114 of the engaging boss 93 and the accepting recess 181 of the second engaging portion 180 an be engaged in a sure manner, as illustrated in FIG. 9. The first guide surface 115 is inclined toward the center axial line of the engaging boss 93 in the left direction. Accordingly, the engagement of the tip end portion 114 of the engaging boss 93 and the accepting recess 181 of the second engaging portion 180 can be guided in a sure manner.

6. Second Embodiment

Next, a second embodiment of the present invention will be described.

Figure 15A:
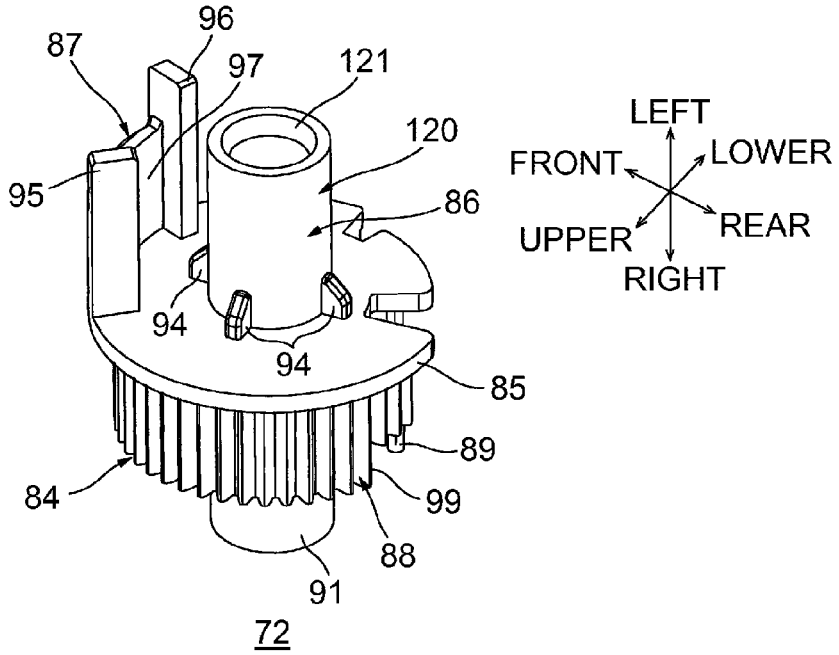
FIG. 15A is a perspective view of a detection gear of a printer according to a second embodiment of the present invention as viewed from the lower rear side.
Figure 15B:
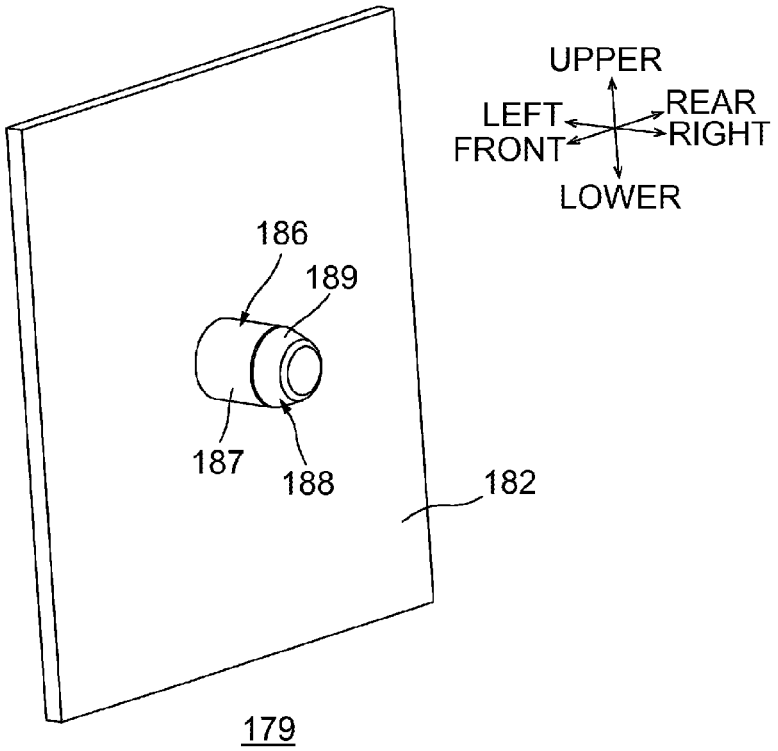
FIG. 15B is a perspective view of an engaging unit of the printer according to the second embodiment of the present invention as viewed from the right front side.
Figure 16:
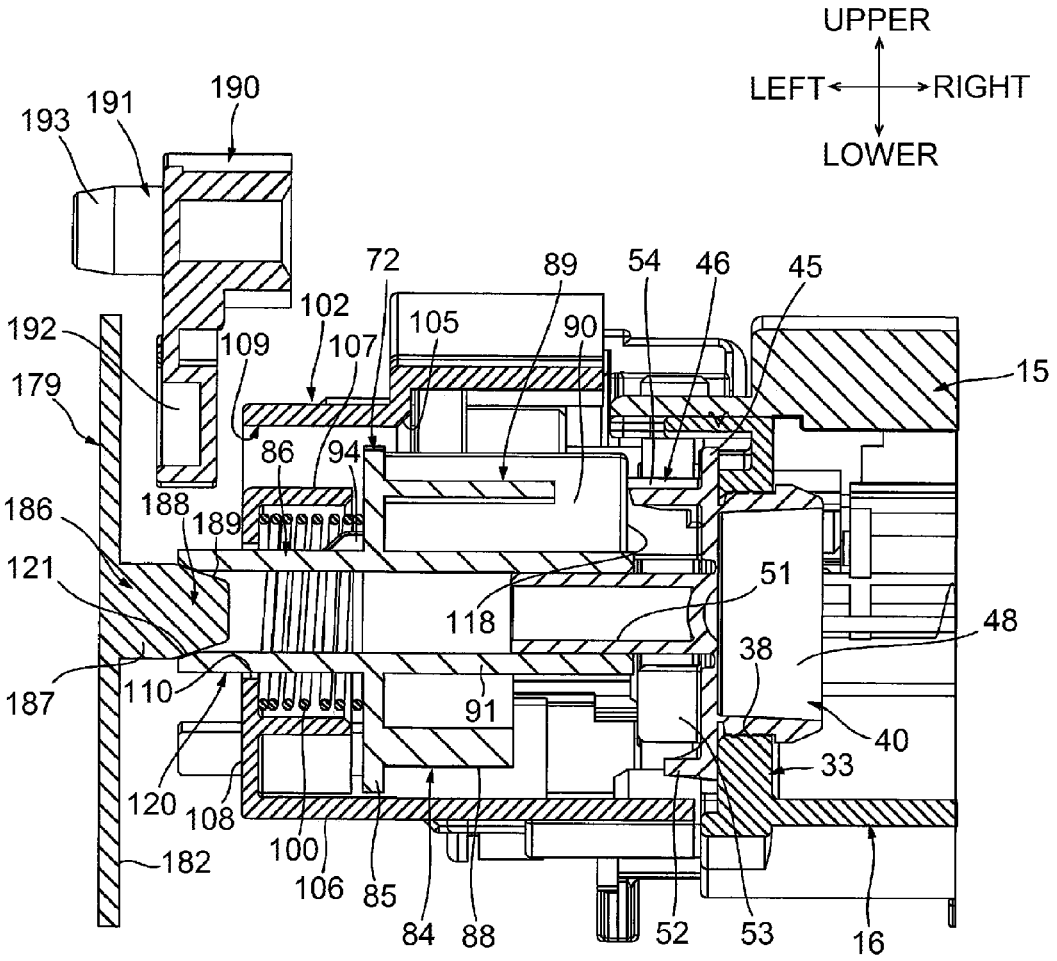
FIG. 16 is a cross-sectional view of a state where the detection gear illustrated in FIG. 15A and the engaging unit illustrated in FIG. 15B are engaged, taken in a radial direction of a boss.

Portions in FIGS. 15A through 16 which correspond to those in FIGS. 1 through 14 are denoted with the same reference numerals, and description thereof will be omitted.

The detection gear 72 according to the above-described first embodiment has an engaging boss 93 such as illustrated in FIG. 3B. However, the present embodiment is not restricted to this embodiment, and the detection gear 72 according to the second embodiment has an engaging cylinder 120 which is an example of a cylindrical member, instead of the engaging boss 93, as illustrated in FIG. 15A.

The engaging cylinder 120 has a general cylinder shape of which the center axial line matches that of the plate portion 85, protruding to the left from the generally middle portion in the radial direction of the plate portion 85. The inner perimeter face of the engaging cylinder 120 at the left side has a first guide surface 121 to guide engagement between a tip portion 188 and the engaging cylinder 120, and a later-described column portion 186.

The first guide surface 121 is inclined toward the inner side in the radial direction of the engaging cylinder 120, toward the right, as illustrated in FIG. 16.

That is to say, the first guide surface 121 is an inclined surface which is situated at the left tip portion of the engaging cylinder 120, inclined away from the center axial line of the engaging cylinder 120 toward the left.

The engaging unit 179 which the main unit casing 2 has includes a column portion 186 as an example of a second engaging portion, corresponding to the engaging cylinder 120.

The column portion 186 is situated at the generally middle portion on the right face of the plate 182. The column portion 186 has a general columnar shape extending in the left-right direction, protruding to the right from the right face of the plate 182.

More specifically, the column portion 186 has a base end portion 187 and the tip portion 188. The base end portion 187 is a generally columnar shape extending in the left-right direction. The outer diameter of the base end portion 187 is larger than the inner diameter of the engaging cylinder 120. The tip portion 188 has a conical trapezoid shape which protrudes to the right from the right face of the base end portion 187. The diameter of the base face (right face) of the tip portion 188 is generally the same as the outer diameter of the base end portion 187. The perimeter face of the tip end portion 188 defines a second guide surface 189 which guides engagement between the tip end portion 188 and the engaging cylinder 120.

Upon the detection gear 72 moving from the initial position to the advanced position in the same way as with the first embodiment, as illustrated in FIG. 16, the engaging cylinder 120 moves from the first position to the second position in this second embodiment.

At this time, the first guide surface 121 and the second guide surface 189 each guide engagement of the engaging cylinder 120 and the tip portion 188 of the column portion 186.

Upon the engaging cylinder 120 reaching the second position, the left end of the engaging cylinder 120 accepts the tip portion 188 of the column portion 186. At this time, the engaging cylinder 120 is positioned as to the column portion 186 by the first guide surface 121 and the second guide surface 189 coming into contact.

Next, upon the detection gear 72 at the advance position further rotating which maintaining the positioned state of the engaging cylinder 120 as to the column portion 186, the detected portion 87 is detected by the detection mechanism 190 in the same way as with the first embodiment.

Accordingly, advantages the same as with the first embodiment can be obtained with the second embodiment as well.

Also, the first engaging portion 86 has the engaging cylinder 120 extending in the left-right direction, whereby the engaging cylinder 120 and the column portion 186 can be engaged in a sure manner. Also, the first guide surface 121 is inclined away from the center axial line of the engaging cylinder 120 toward the left. Accordingly, engagement of the engaging cylinder 120 and column portion 186 can be guided in a sure manner.

7. Modifications (1) The first and second embodiments have been described with the detection gear 72 advancing and retracting in the left-right direction when rotating from the initial position to the destination position, but the present invention is not restricted to this arrangement, and detection gear 72 does not have to advance and retract in the left-right direction, as long as it rotates from the initial position to the destination position.

In this case, the main unit casing 2 has a cam unit, which is not illustrated. The cam unit includes a pinion gear, a linear cam which is an example of a second engaging portion, and a tension spring.

The pinion gear is disposed so as to mesh with the detection gear portion 88 of the detection gear 72 in a state where the developing cartridge 15 is mounted to the main unit casing 2, though this is omitted from illustration.

The linear cam has a rectangular shape in side view, extending in the front-back direction, and is disposed at the upper rear of the pinion gear, though this is omitted from illustration. The linear cam also has a rack gear disposed on the lower face of the liner cam. The front end portion of the rack gear meshes with the pinion gear.

The linear cam is configured to be movable in the front-back direction, with vertical movement as to the main unit casing 2 being restricted.

The front end of the tension spring is connected to the rear end of the linear cam, thereby pressing the linear cam rearwards, though this is omitted from illustration.

Upon the driving force being transmitted from the agitator gear 71 to the detection gear 72, and the detection gear 72 rotating counterclockwise in left side view form the initial position toward the destination position, the pinion gear meshing with the detection gear portion 88 of the detection gear 72 rotates clockwise in left side view.

The linear cam meshed with the pinion gear moves forward against the biasing force of the tension spring, and reaches above the pinion gear. Accordingly, the linear cam and the detection gear portion 88 are engaged via the pinion gear, by rotation of the detection gear 72. Note that in this modification, the detection gear portion 88 is an example of a first engaging portion.

Next, upon the detection gear 72 further rotating while maintaining the state where the detection gear portion 88 and linear cam are engaged via the pinion gear, the linear cam moves further forward, and the detected portion 87 moves in the rotational direction R. Accordingly, the detected portion 87 is detected by the detection mechanism 190 in the same way as with the first embodiment.

Next, upon the detection gear 72 further rotating, the connecting portion 92 of the detection gear 72 reaches beneath the pinion gear, so meshing between the pinion gear and the detection gear portion 88 is disengaged. The linear cam then moves toward the back under the biasing force of the tension spring, and retreats from the path for mounting/detaching the developing cartridge 15 to/from the main unit casing 2. The pinion gear rotates counterclockwise in left side view along with the movement of the linear cam.

Thereafter, the detection gear 72 reaches the destination position in the same way as with the first embodiment.

(2) The first and second embodiments have been described with the optical sensor 194 being configured to output an off signal when detecting rocking of the actuator 191 from a detection position to non-detection position, but the present invention is not restricted to this, and may be configured to stop output of the on signal.

(3) The first and second embodiments have been described with the developing cartridge 15 being mounted to and detached from the drum cartridge 24. However, the present invention is not restricted to this, and the developing cartridge 15 may be configured integrally with the drum cartridge 24, for example. Note that in this case, a process cartridge 17 which integrally includes the developing cartridge 15 and drum cartridge 24 serves as an example of a cartridge.

(4) The developing cartridge 15 may be configured such that a toner box accommodating toner is mounted to and detached from a frame having the developing roller 4. In this case, the toner box has the detection unit 32, and serves as an example of a cartridge.

A configuration may also be made where only the developing cartridge 15 is mounted to and detached from the main unit casing 2 having the photosensitive drum 25.

(5) The first and second embodiments have been described with the detection gear 72 being formed of a known plastic, and integrally having the first detection protrusion 95 and second detection protrusion 96. However, the present invention is not restricted to this arrangement, and the detection gear 72 may have the first detection protrusion 95 and second detection protrusion 96 separately. In this case, the first detection protrusion 95 and second detection protrusion 96 are each formed of, for example, resin film, elastic material such as rubber, or the like.

(6) The first and second embodiments have been described with the detection gear 72 being rotatably supported by the cap 40 mounted to the left wall 33. However, the present invention is not restricted to this arrangement, and the detection gear 72 may be directly supported by the housing 16. In this case, the housing 16 includes the detection gear supporting portion 46.

These modification also provide the same advantages as those of the above-described first and second embodiments.

Moreover, the first embodiment, second embodiment, and the modifications may be combined as suitable.

What is claimed is:

1. An image forming apparatus comprising:

an apparatus main body; and a cartridge configured to be mounted to and detached from the apparatus main body, wherein the cartridge comprises a rotating member which is configured to rotate and comprises a detected portion and a first engaging portion, wherein the apparatus main body comprises a detecting portion configured to detect the detected portion and a second engaging portion configured to engage with the first engaging portion, and wherein, at least when the detecting portion detects the detected portion, the first engaging portion and the second engaging portion are engaged with each other by rotation of the rotating member.

2. The image forming apparatus according to claim 1, wherein the first engaging portion is disposed on a center of rotation of the rotating member, as viewed from an axial line direction along a rotation axial line of the rotating member.

3. The image forming apparatus according to claim 1, wherein the first engaging portion and the second engaging portion are configured to engage with each other in an axial direction of the rotating member.

4. The image forming apparatus according to claim 1, wherein the rotating member comprises gear cogs.

5. The image forming apparatus according to claim 4, wherein the gear cogs are disposed at a part of the rotating member.

6. The image forming apparatus according to claim 1, wherein the detecting portion comprises an optical sensor.

7. The image forming apparatus according to claim 1, wherein the detecting portion is configured to detect that the cartridge mounted to the apparatus main body is new.

8. The image forming apparatus according to claim 1, wherein the rotating member is configured to rotate by a driving force transmitted from the apparatus main body.

9. The image forming apparatus according to claim 8, wherein the cartridge comprises a developing roller, and further comprises a gear train comprising a developing gear configured to transmit the driving force to the developing roller, and wherein the driving force to the rotating member is configured to transmitted from the gear train.

10. An image forming apparatus comprising:

an apparatus main body; and a cartridge configured to be mounted to and detached from the apparatus main body, wherein the cartridge comprises a rotating member which is configured to rotate and comprises a detected portion and a first engaging portion, wherein the apparatus main body comprises a detecting portion configured to detect the detected portion and a second engaging portion configured to engage with the first engaging portion, wherein, at least when the detecting portion detects the detected portion, the first en aging portion and the second engaging portion are engaged with each other by rotation of the rotating member, wherein the cartridge comprises a wall on which the rotating member is disposed, and wherein the first engaging portion is configured to move, in conjunction with the rotation of the rotating member, to:

a first position where is near the wall in an axial line direction along a rotation axial line of the rotating member and where the first engaging portion is separate from the second engaging portion; and a second position where is separate from the wall in the axial line direction and where the first engaging portion engages with the second engaging portion.

11. The image forming apparatus according to claim 10, the cartridge comprises an urging member configured to urge the rotating member in a direction from the second position to the first position.

12. The image forming apparatus according to claim 11, wherein the urging member comprises a coil spring.

13. An image forming apparatus comprising:

an apparatus main body; and a cartridge configured to be mounted to and detached from the apparatus main body, wherein the cartridge comprises a rotating member which is configured to rotate and comprises a detected portion and a first engaging portion, wherein the apparatus main body comprises a detecting portion configured to detect the detected portion and a second engaging portion configured to engage with the first engaging portion, wherein, at least when the detecting portion detects the detected portion, the first engaging portion and the second engaging portion are engaged with each other by rotation of the rotating member, and wherein one of the first engaging portion and the second engaging portion has a first guide surface configured to guide the other of the first engaging portion and the second engaging portion, when the one of the first engaging portion and the second engaging portion engages with the other of the first engaging portion and second engaging portion.

14. The image forming apparatus according to claim 13, wherein the other of the first engaging portion and the second engaging portion has a second guide surface configured to guide the one of the first engaging portion and the second engaging portion, when the other of the first engaging portion and the second engaging portion engages with the one of the first engaging portion and second engaging portion, and wherein the first engaging portion is configured to be positioned with respect to the second engaging portion by the first guide surface coming into contact with the second guide surface.

15. The image forming apparatus according to claim 13, wherein the first engaging portion comprises a columnar member extending in an axial line direction along a rotation axial line of the rotating member, and wherein the first guide surface is positioned outside the axial line direction of the columnar member and has an inclined surface which inclines toward a center axial line of the columnar member, toward outside the axial line direction.

16. The image forming apparatus according to claim 13, wherein the first engaging portion comprises a cylindrical member extending in an axial line direction along a rotation axial line of the rotating member, and wherein the first guide surface is positioned outside the axial line direction of the cylindrical member and has an inclined surface which inclines away from a center axial line of the cylindrical member, toward outside the axial line direction.

17. An image forming apparatus comprising:

an apparatus main body; and a cartridge configured to be mounted to and detached from the apparatus main body, wherein the cartridge comprises a rotating member which is configured to rotate and comprises a detected portion and a first engaging portion, wherein the apparatus main body comprises a detecting portion configured to detect the detected portion and a second engaging portion configured to engage with the first engaging portion, wherein, at least when the detecting portion detects the detected portion, the first engaging portion and the second engaging portion are engaged with each other by rotation of the rotating member, and wherein the first engaging portion is configured to move ahead toward the second engaging portion by the rotating member rotating to engage with the second engaging portion.

* * * * *